US005992981A

United States Patent [19]

Sugitani et al.

[11] Patent Number: 5,992,981

[45] Date of Patent: Nov. 30, 1999

[54] INK JET HEAD, INK JET APPARATUS, AND METHOD OF AND APPARATUS FOR MANUFACTURING THE HEAD

[75] Inventors: Hiroshi Sugitani, Machida; Masami Kasamoto, Ayase; Tsuyoshi Orikasa, Masashimurayama; Masashi Miyagawa, Yokohama; Jun Kawai, Tokyo; Teruo Arashima; Masaaki Izumida, both of Kawasaki, all of Japan

[73] Assignee: Canon Kabushiki Kaisha, Tokyo, Japan

[21] Appl. No.: 08/281,006

[22] Filed: Jul. 27, 1994

[30] Foreign Application Priority Data

Jul. 29, 1993 [JP] Japan ..... 5-188354
Jul. 29, 1993 [JP] Japan ..... 5-188356
Jul. 21, 1994 [JP] Japan ..... 6-169791

[51] Int. Cl.[6] ..... B41J 2/05
[52] U.S. Cl. ..... 347/63
[58] Field of Search ..... 347/65, 64, 63, 347/20, 49, 42

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,412,224 | 10/1983 | Sugitani | 347/65 |
| 4,437,100 | 3/1984 | Sugitani et al. | 347/65 |
| 4,459,600 | 7/1984 | Sato et al. | 347/47 |
| 4,463,359 | 7/1984 | Ayata et al. | 347/56 |
| 4,520,373 | 5/1985 | Ayata et al. | 347/42 |
| 4,521,787 | 6/1985 | Yokota et al. | 347/65 |
| 4,558,333 | 12/1985 | Sugitani et al. | 347/65 |
| 4,609,427 | 9/1986 | Inamoto et al. | 156/633 |
| 4,666,823 | 5/1987 | Yokota et al. | 430/320 |
| 4,723,129 | 2/1988 | Endo et al. | 347/56 |
| 4,740,796 | 4/1988 | Endo et al. | 347/56 |
| 4,774,530 | 9/1988 | Hawkins | 347/63 |
| 5,030,317 | 7/1991 | Noguchi | 347/65 |
| 5,030,973 | 7/1991 | Nonoyama et al. | 347/93 |
| 5,095,321 | 3/1992 | Saito et al. | 347/20 |
| 5,098,503 | 3/1992 | Drake | 156/299 |
| 5,148,194 | 9/1992 | Asai et al. | 347/49 |
| 5,175,565 | 12/1992 | Ishinaga et al. | 347/67 |
| 5,455,612 | 10/1995 | Ikeda et al. | 347/64 |
| 5,484,075 | 1/1996 | Kimura et al. | 347/63 |

FOREIGN PATENT DOCUMENTS

| | | |
|---|---|---|
| 59-123670 | 7/1984 | Japan . |
| 59-138461 | 8/1984 | Japan . |
| 60-206654 | 10/1985 | Japan . |
| 63-202455 | 8/1988 | Japan . |
| 2-67140 | 3/1990 | Japan . |
| 2176443 | 12/1986 | United Kingdom . |

*Primary Examiner*—N. Le
*Assistant Examiner*—Judy Nguyen
*Attorney, Agent, or Firm*—Fitzpatrick, Cella, Harper & Scinto

[57] ABSTRACT

An ink jet head includes a heater board having a substrate on which a plurality of energy generating elements for generating energy utilized to discharge ink are provided, and a wall member joined to the heater board. The wall member has a plurality of flow passage walls which partially define flow passages, and the energy generated by the energy generating element acts through the flow passage so as to act on the ink to discharge the ink. The flow passages are fully defined when the heater board is joined to the wall member. A recessed portion provided in the heater board of the ink jet head is positioned between adjoining energy generating elements. The recessed portion has a bottom surface located at a position which is lower than a position for a heat acting surface of the heater board along which heat is transmitted to the ink. The flow passage walls of the wall member abut the heater board at the bottom surface. Consequently, any pressure wave generated by the energy generating element is not released to an adjacent flow passage, and crosstalk between the adjoining flow passages can be prevented. As a result, an ink jet head exhibiting excellent printing quality can be provided.

9 Claims, 14 Drawing Sheets

INK JET HEAD, INK JET APPARATUS, AND METHOD OF AND APPARATUS FOR MANUFACTURING THE HEAD

BACKGROUND OF THE INVENTION

1. Field of the Invention

The present invention relates to an ink jet head and an ink jet head apparatus having the ink jet head. Furthermore, the present invention relates to a method of and an apparatus for manufacturing the ink jet head, and more particularly, to the alignment in manufacture of energy generating elements employed for discharge in the head.

2. Description of the Related Art

FIGS. 1 and 2 show an example of a conventional ink jet head. FIG. 1 is a longitudinal cross-sectional view partially showing a surface of a head which is cut horizontally along a discharge port row. FIG. 2 is a cross-section taken along the line 2–2' of FIG. 1.

As shown in FIG. 1, a plurality of discharge ports 1101 are provided in a conventional ink jet head. An electro-thermal transducer for generating thermal energy utilized to discharge a liquid (hereinafter referred to as an ink) from the discharge port 1101 is provided for every ink flow passage 1108. Each of the electro-thermal transducers 1103 is mainly constituted by a heating resistor 1102 and electrode interconnections 1110 for supplying power to the heating resistor 1102.

More specifically, as shown in FIG. 2, an insulator film 1111 and an interlayer film 1112 are formed on a substrate 103 made of, for example, silicon, and a heating resistor layer 1102 having a pattern such as that shown in FIG. 1 is formed on these films. Patterned electrode interconnections 1110 made of, for example, Al are formed on a portion of the heating resistor layer 1102. The portion of the heating resistor layer 1102 on which no electrode interconnections are formed constitutes a heating portion 1116.

Furthermore, a first protective film 1113 and a second protective film 1114 are coated on the patterned heating resistor layer 1102 and the electrode interconnection 1110. A heater board 104 (see FIG. 2) is constituted by the substrate 103, the electro-thermal transducers formed on the substrate 103 and so on.

Referring to FIG. 1, the ink flow passages 1108 are partitioned by flow passage walls 1109. The end portions of the ink flow passages 1108 remote from the discharge ports 1101 communicate with a common liquid chamber 1106. The common liquid chamber 1106 stores the ink supplied from an ink tank (not shown). The ink supplied from the common liquid chamber 1106 is introduced to each of the ink flow passages 1108 where it is retained by virtue of the meniscus formed near the discharge port 1101. At that time, if the electro-thermal transducer 1103 is selectively driven, film boiling occurs in the ink as a result of the thermal energy generated by the electro-thermal transducer 1103, generating a bubble and in turn, ejecting ink. The ink is discharged from the discharge port 1101 by virtue of the growth of the bubble.

A ceiling plate 105 made of, for example, a resin is joined onto the heater board 104 of the ink jet head.

More specifically, the ceiling plate 105 is a unit in which an orifice plate 1104 having the discharge ports 1101 formed therein is integrally formed with the flow passage walls 1109. The ceiling plate 105 is joined to the heater board 104 in the manner described below: as shown in FIG. 2, the ceiling plate 105 is placed while aligning the discharge port forming portion of the ceiling plate 105 relative to the electro-thermal transducers on the heater board 104 by means of, for example, the image processing, and a rear portion of the ceiling plate 105 (remote from the discharge port forming portion) is then temporarily fixed by, for example, an adhesive. Thereafter, the flow passage walls are pressed by an elastic member (not shown), such as a plate spring, from above, whereby the adjacent electro-thermal transducers 1103 on the heater board 104 are separated from each other by the flow passage walls 1109 in such a manner that a single electro-thermal transducer 1103 is disposed in every ink flow passage 1108.

However, in the conventional heater board structure described above, since the lower end of the flow passage wall 1109 of the ceiling plate 105 is brought into contact with a flow passage wall joining surface 1115 forming a convex portion on the heater board 104, if a small gap is created between the flow passage wall 1109 and the joining surface 1115, the ink pressure waves generated by bubbling may propagate to the adjoining ink flow passages, transferring the bubbling energy to the adjacent ink flow passages. This makes ink discharge unstable. Particularly, this becomes a serious problem in a case where the electro-thermal transducers 1103 and the flow passage walls 1109 are provided close to each other as a consequence of an increase in the resolution of the ink jet head.

Further, in the above structure in which the heater board 104 and the ceiling plate 105 are closely attached to each other by means of the elastic member, such as a plate spring, without using an adhesive, the direction in which the fixing force is applied may vary or the positioning accuracy may deteriorate, thus generating a positional deviation between the ceiling plate 105 and the heater board 103. In that case, in the above-described structure in which the flow passage walls 1109 are brought into contact with the convex portions on the heater board 104, even if the above gap is very small, a portion of the flow passage wall 1109 may rise above the convex portion or the flow passage wall 1109 may rise on the electro-thermal transducer 1103. In these cases, unstable bubbling, transfer of the bubbling energy into the adjacent ink flow passages or crosstalk may occur, making the dot diameter non-uniform or degrading the recording quality.

SUMMARY OF THE INVENTION

In view of the aforementioned problems, an object of the present invention is to provide an ink jet head and an ink jet apparatus which avoid or at least reduce the loss of discharge energy which would otherwise escape to adjacent ink flow passages, ensuring excellent discharge.

To achieve the above object, the present inventors studied intensively and found an improved ink jet head and an improved ink jet apparatus.

The present invention provides an ink jet head including a heater board having a substrate having a plurality of energy generating elements for generating energy utilized to discharge ink provided thereon, the heater board having a recessed portion, and a wall member joined to the heater board, this wall member having plural flow passage walls which partially define plural flow passages. The energy generated by the energy generating elements acts through the flow passages so as to act on the ink to discharge the ink, the flow passages being fully-defined when the substrate is joined to the wall member. The recessed portion of the substrate is provided between the adjoining energy generating elements, and this recessed portion has a bottom surface located at a position which is lower than a position of a heat acting surface of the substrate along which heat is transmitted to the ink, the flow passage walls of the wall member abutting the substrate at the bottom surfaces.

Another aspect of the present invention relates to an ink jet apparatus which includes an ink jet head having a heater board having a having plural energy generating elements for generating energy utilized to discharge ink provided thereon, the substrate having a recessed portion and a wall member joined to the substrate, the wall member having plural flow passage walls which partially define plural flow passages. The energy generated by the energy generating elements acts through the flow passages so as to act on the ink to discharge the ink, the flow passages being defined when the substrate engages the wall member, and a driving signal generation means generates signals for driving the energy generating elements of the ink jet head. The recessed portion has a bottom surface located at a position which is lower than the position of a heat acting surface of the heater board along which heat is transmitted to the ink, and the flow passage walls of the wall member abut the heater board at the bottom surfaces.

In the present invention, since the wall member, such as an ink flow passage wall, of the ceiling plate is brought into abutment with the bottom surface of the recessed portion provided in the substrate at a position which is lower than the heat acting surface and is not thus affected by the pressure wave generated in the ink by the energy generating element on the substrate, the pressure wave does not reach the other flow passages through the recessed portion. Further, even if the wall member shifts from its contact position for any reason, it interferes with part of the recessed portion and does not rise above the shoulder of the recessed portion.

Consequently, a positional deviation of, for example, the ceiling plate can be reduced. Further, since discharge energy losses to the adjacent flow passages can be reduced, discharge can be performed in a state wherein there is substantially no crosstalk between the adjacent flow passages, stabilizing discharge. As a result, excellent recording results, such as a fixed dot size, can be obtained.

The present invention also relates to a method of manufacturing an ink jet head having a heater board having plural energy generating elements for generating energy utilized to discharge ink provided thereof, the heater board having a recessed portion, and a wall member joined to the heater board, the wall member having plural flow passage walls which partially define plural flow passages, the energy generated by the energy generating elements acting through these flow passages so as to act on the ink to discharge the ink. The flow passages are fully-defined when the heater board is joined to the wall member. This method involves providing recessed portion in the substrate, fitting those recessed portions to the flow passage walls of the wall member by applying a force to the wall member along a direction in which the energy generating elements are arranged, thereby aligning the flow passages with the energy generating elements.

Still another aspect of this invention is a method of manufacturing an ink jet head having a heater board having plural energy generating elements for generating energy utilized to discharge ink provided thereon, the heater board having a recessed portion, and a wall member joined to the heater board and having a plurality of flow passage walls which partially define plural flow passages. The energy generated by the energy generating elements acts through the flow passages so as to act on the ink to discharge the ink. The flow passages are fully-defined when the heater board and wall member are joined. This method involves providing plural recessed portions in the heater board, and fitting the recessed portions to the flow passage walls of the wall member by vibrating the heater board so that a force having at least a component acting in a direction in which the energy generating elements are arranged is applied to the wall member. This serves to align the flow passages with the energy generating elements.

Furthermore, this invention concerns an apparatus for manufacturing an ink jet head having a heater board having plural energy generating elements for generating energy utilized to discharge ink provided thereon, this heater board having a recessed portion, and a wall member joined to the heater board and having a plurality of flow passage walls which partially define plural flow passages. The energy generated by the energy generating element acts through the flow passages so as to act on the ink to discharge the ink, and the recessed portion is fitted to each of the flow passage walls formed in the heater board so that the flow passages are defined when the flow passage walls engage the recessed portions. This apparatus includes retaining means for retaining the heater board in which the recessed portions are provided, placing means for placing the wall member on the heater board retained by the retaining means so that the recessed portions oppose the flow passage walls, and pressing means for pressing the wall member with a force having at least a force component in a direction in which the plurality of energy generating elements are arranged, the wall member having been placed by the placing means in a state where it member is stacked on the heater board. Vibration means vibrates the heater board so that the force component acts in the direction in which the energy generating elements are arranged.

In the present invention, even if accurate alignment is not achieved when the ceiling plate is joined to the heater board, the flow passage walls of the ceiling plate enter the recessed portions provided in the heater board by causing a force in a direction in which the energy generating elements are arranged to act on the ceiling plate. Consequently, the ink discharge ports can be brought into accurate alignment with the energy generating elements.

As a result, alignment can be readily performed using a simple structure, and cost and time required for manufacturing ink jet heads can thus be reduced.

BRIEF DESCRIPTION OF THE DRAWINGS

FIG. 14(*c*) schematically shows the engagement of a spring with a top portion of the ceiling plate.

DETAILED DESCRIPTION OF THE PREFERRED EMBODIMENTS

Embodiments of the present invention will now be described with reference to the accompanying drawings.

Figure 3:
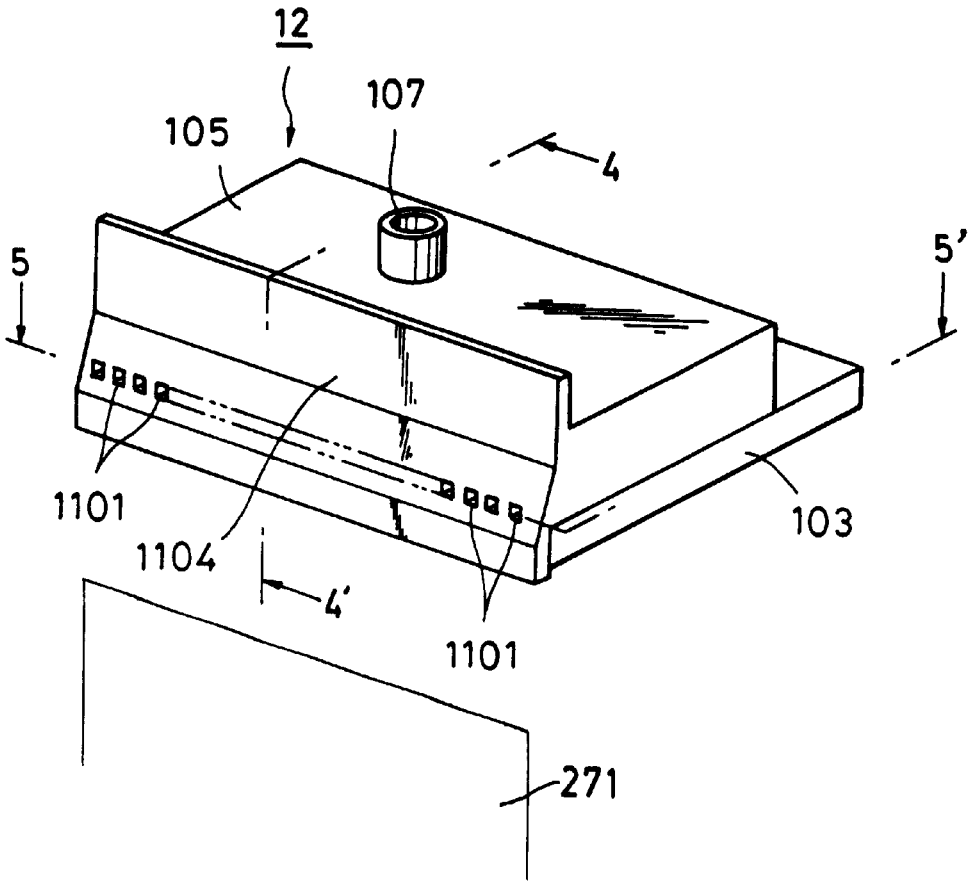
FIG. 3 is a schematic perspective view of an embodiment of an ink jet head according to the present invention.
Figure 4:
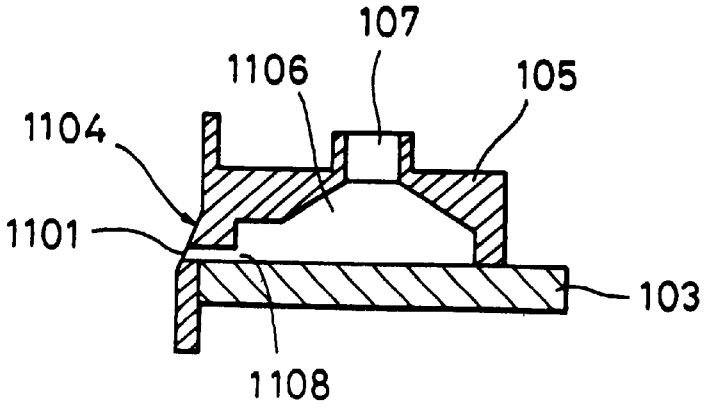
FIG. 4 is a cross-section taken along the line 4–4' of FIG. 3.
Figure 5:
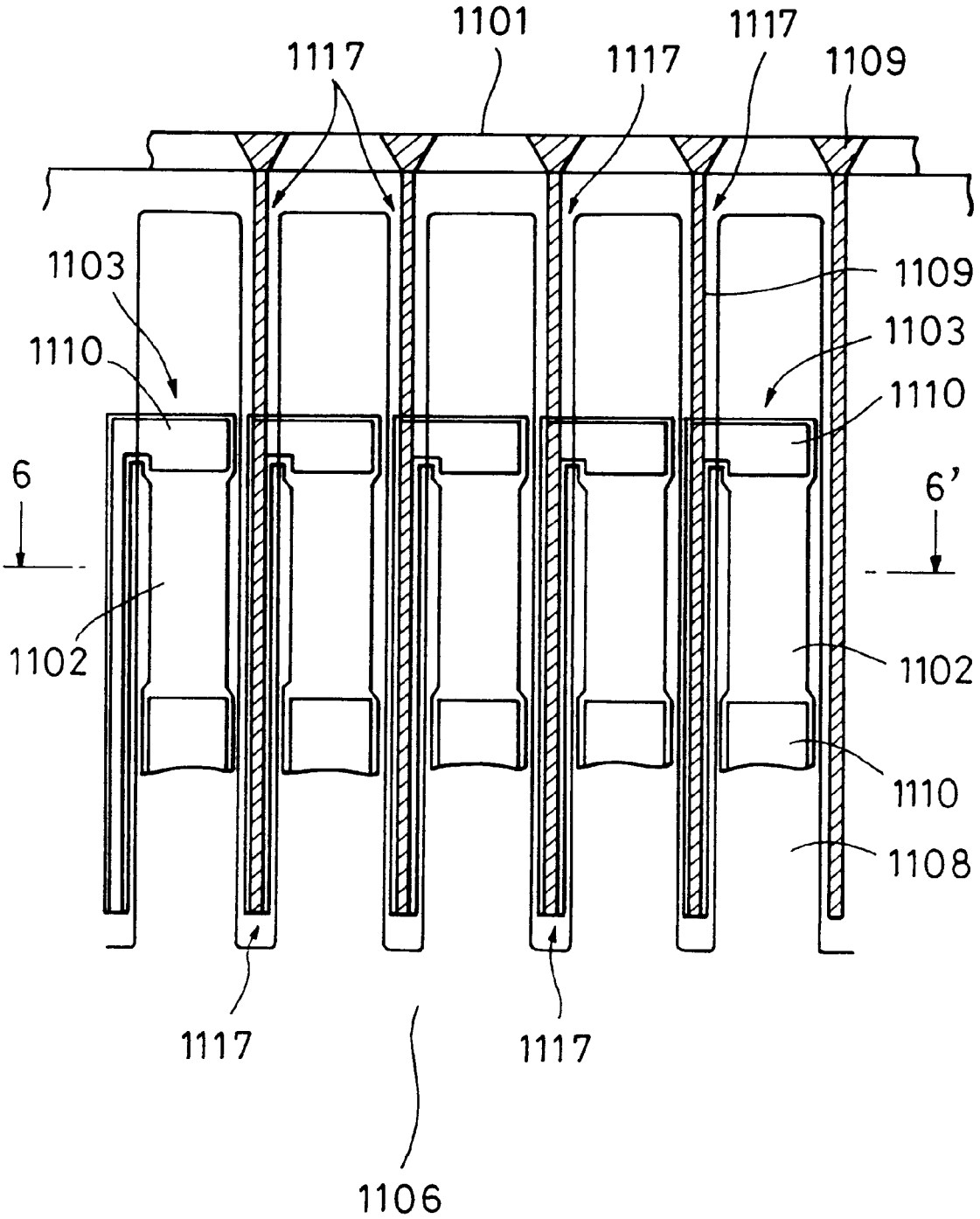
FIG. 5 is a cross-section taken along the line 5–5' of FIG. 3.
Figure 6:
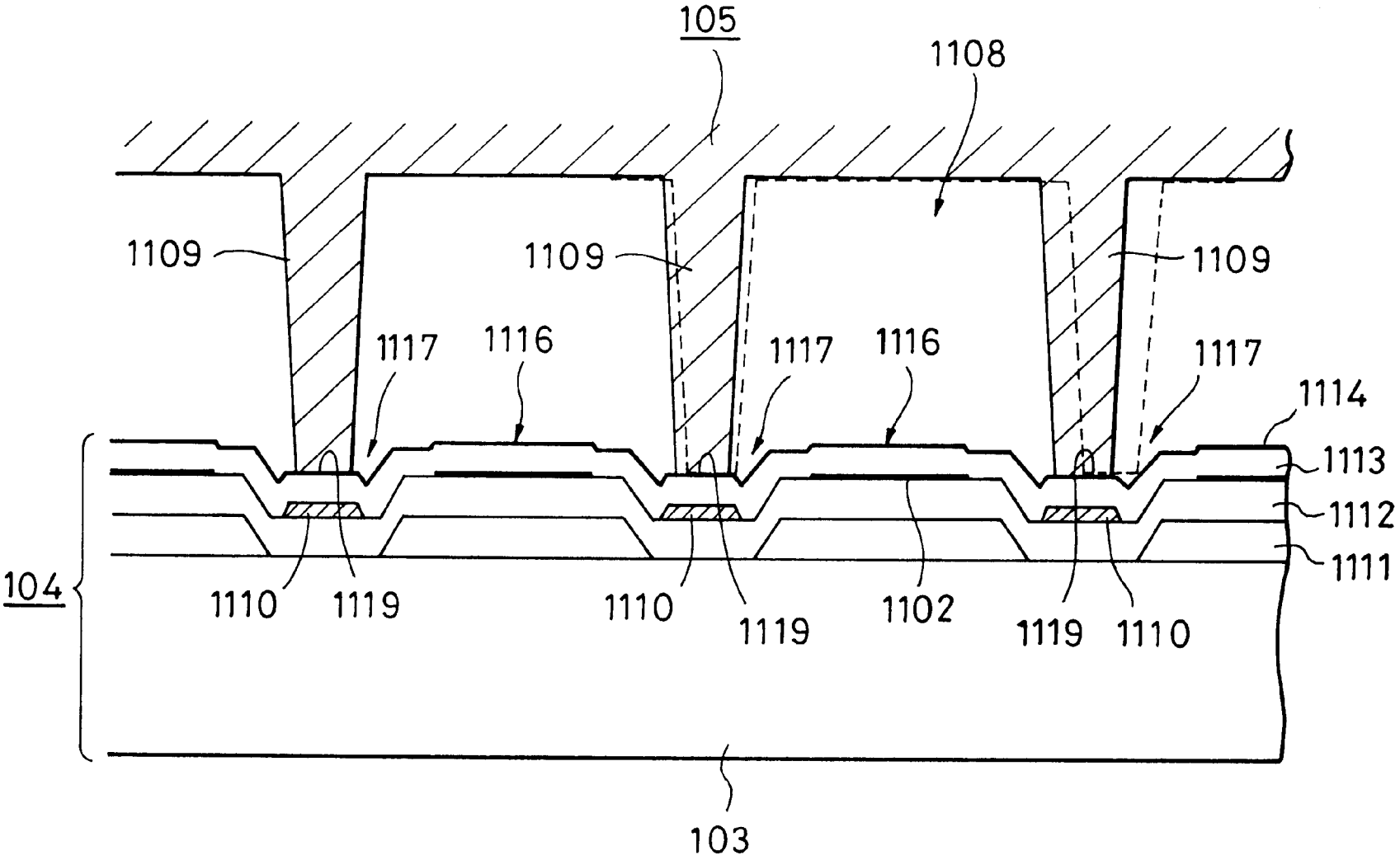
FIG. 6 is a cross-section taken along the line 6–6' of FIG. 5.
Figure 7:
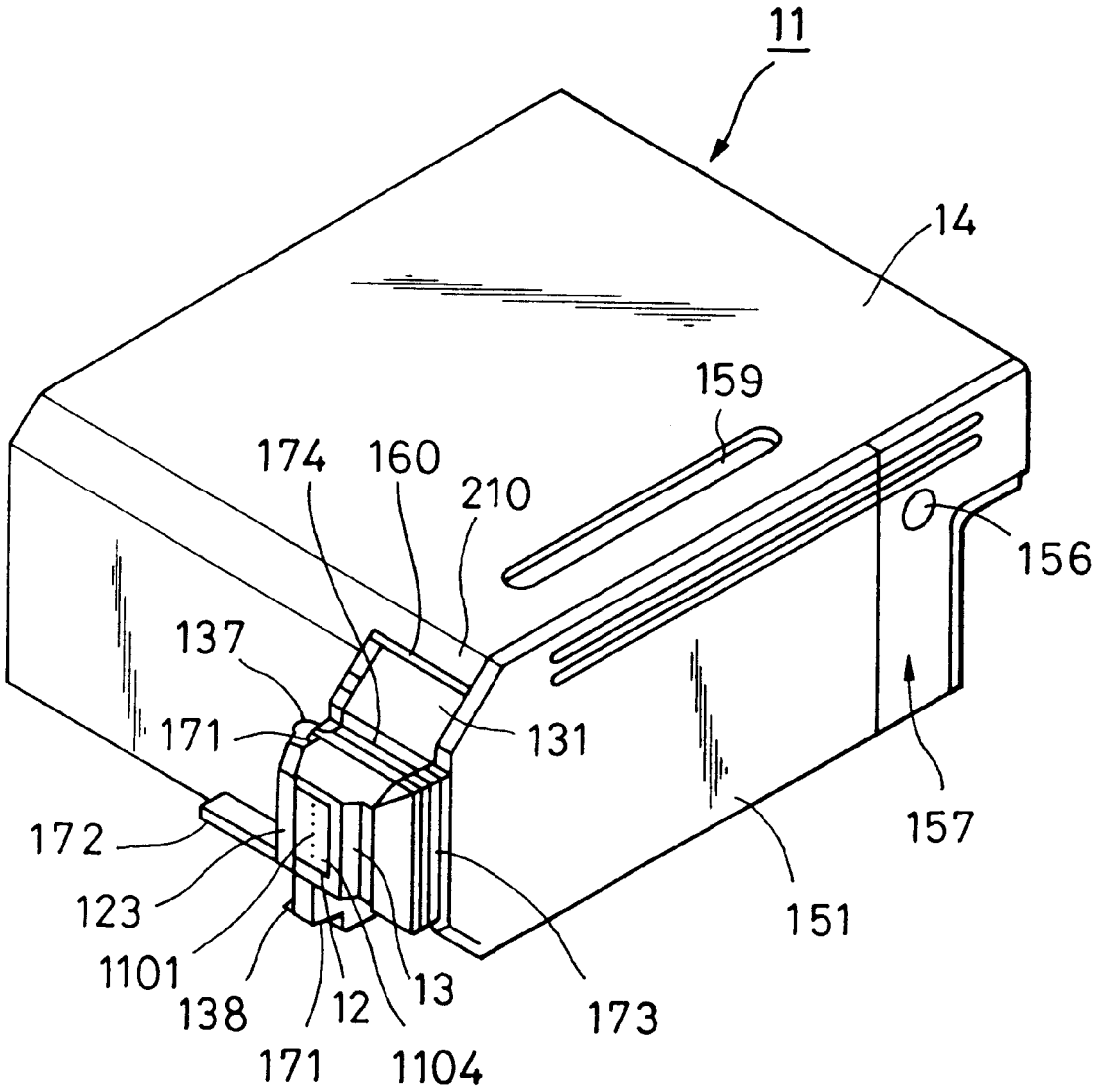
FIG. 7 is a perspective view of an ink jet cartridge in which the ink jet head shown in FIG. 3 is incorporated.
Figure 8:
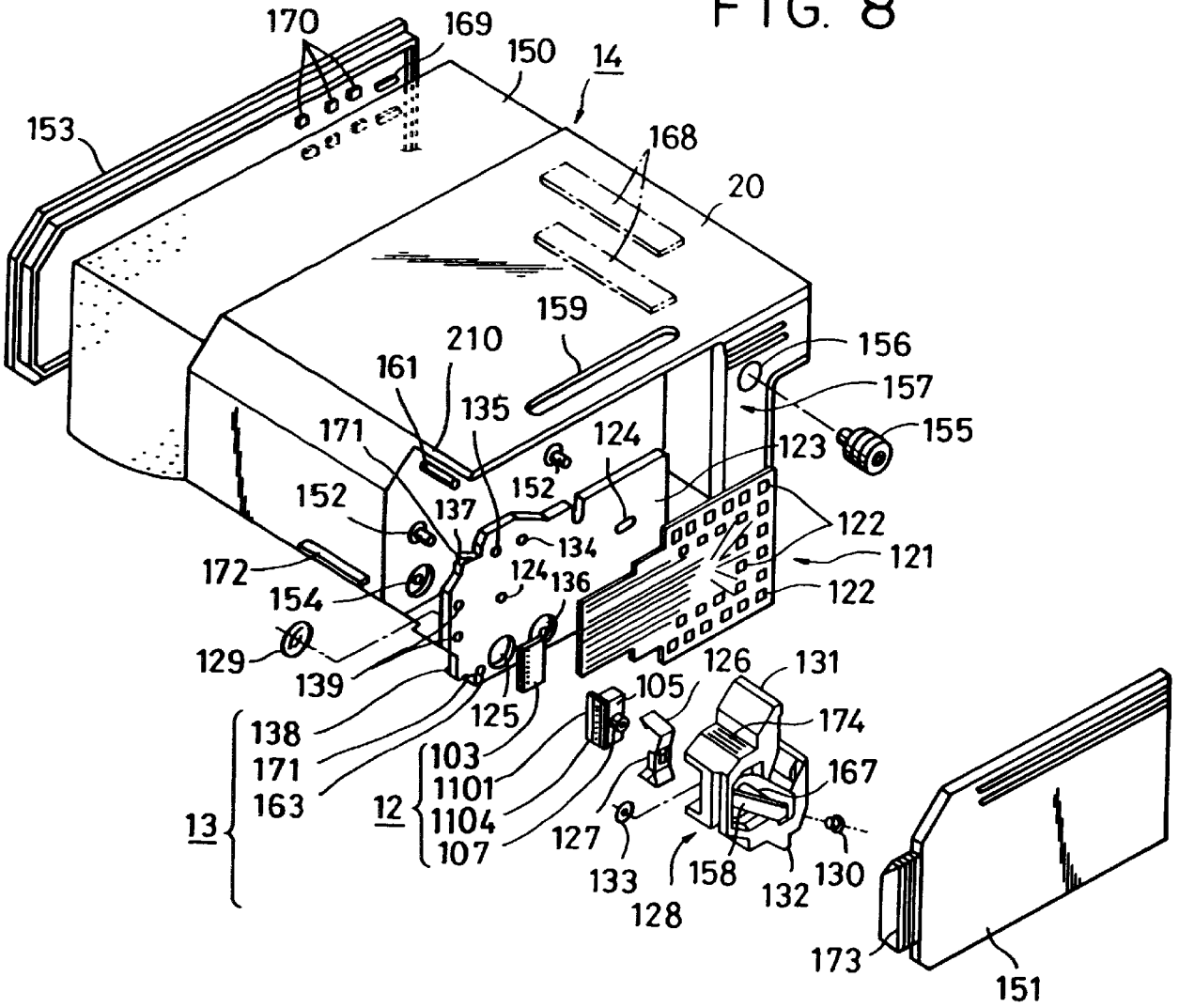
FIG. 8 is a perspective view illustrating the structure of the ink jet cartridge shown in FIG. 7.
Figure 9:
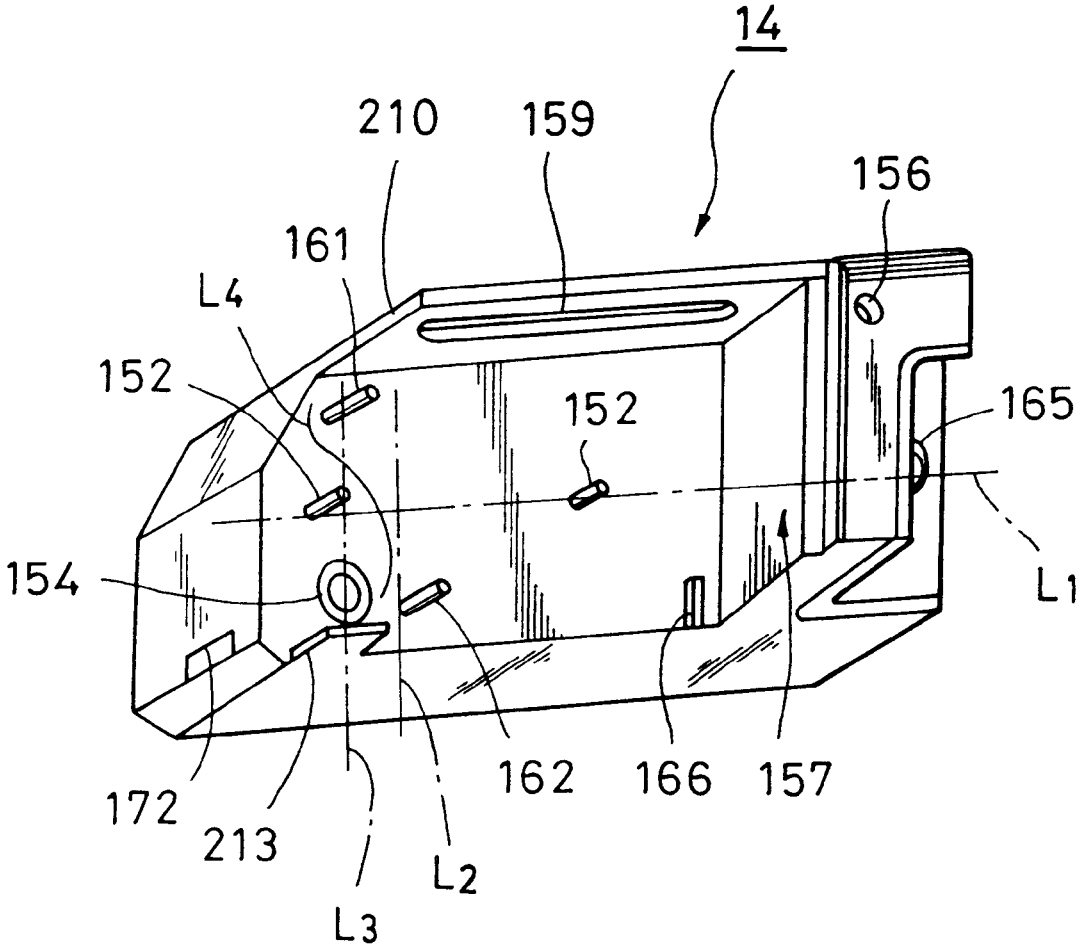
FIG. 9 illustrates a portion of an ink tank on which an ink jet unit is mounted in the ink jet cartridge shown in FIG. 7.

FIG. 3 is a schematic perspective view of a first embodiment of an ink jet head according to the present invention. FIG. 4 is a cross-section taken along the line 4–4' of FIG. 3. FIG. 5 is a cross-section taken along the line 5–5' of FIG. 3. FIG. 6 is a cross-section taken along the line 6–6' of FIG. 5. FIG. 7 is a perspective view of an ink jet cartridge in which the ink jet head shown in FIG. 3 is incorporated. FIG. 8 is an exploded perspective view of the ink jet cartridge shown in FIG. 7. FIG. 9 illustrates a portion of the ink jet cartridge 11 shown in FIG. 7 on which an ink jet unit 13 of an ink tank 14 is mounted.

An ink jet cartridge 11 includes an ink jet head 12 in which the large number of discharge ports 1101 are formed, an ink jet unit 13 which contains the ink jet head 12 and in which electrical interconnections connected to the ink jet head 12 and ink conduits are formed, and an ink tank 14 serving as an ink accommodating portion for accommodating an ink. The ink jet cartridge 11 has an ink accommodating capacity larger than that of a conventional ink jet cartridge, and is located in such a manner that a distal end portion of the ink jet unit 13 protrudes slightly from a front surface of the ink tank 14. As will be described later, the ink jet cartridge 11 is of a disposable type which is fixedly supported by a positioning mechanism and an electric contact portion provided on a carriage placed on an ink jet recording apparatus body in such a manner that it can be mounted on and removed from the carriage (see FIGS. 10 and 11).

Figure 1:
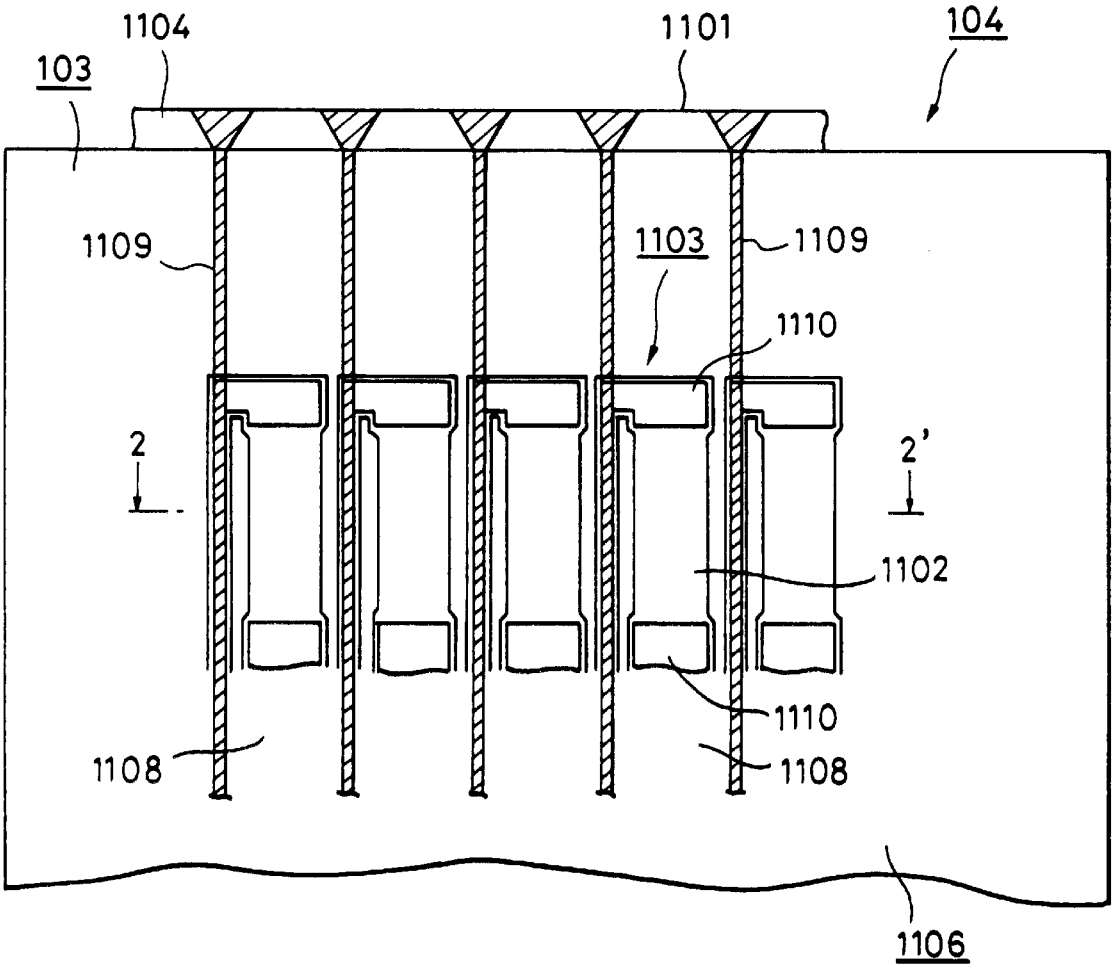
FIG. 1 PRIOR ART
FIG. 1 is a schematic plan view illustrating an example of a heater board structure of a conventional ink jet head.
Figure 2:
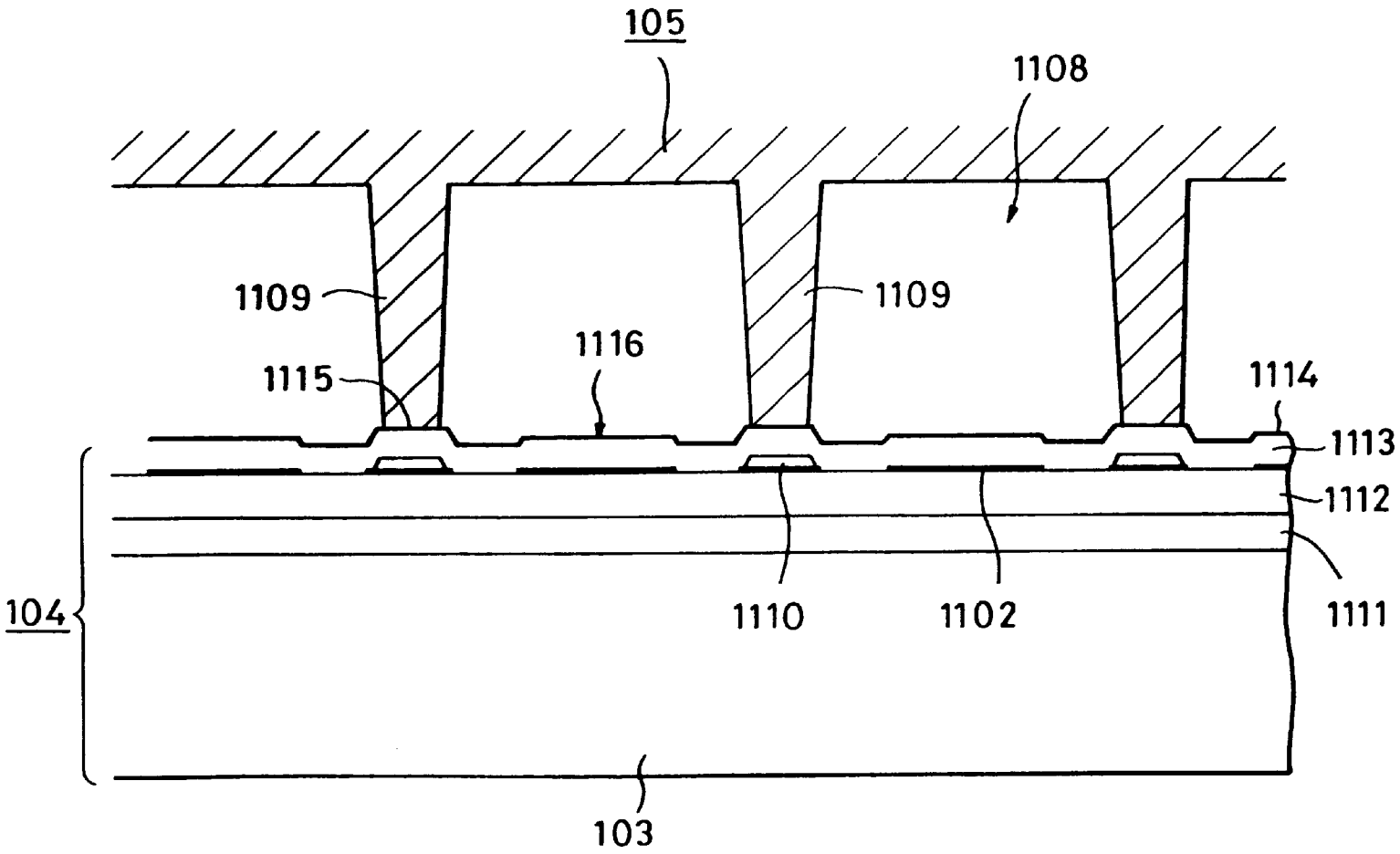
FIG. 2 PRIOR ART
FIG. 2 is a cross-section taken along the line 2–2' of FIG. 1.

First, the structure of the ink jet head 12 will be described with reference to FIGS. 3 through 5. Identical reference numerals in these figures to those in FIGS. 1 and 2 represent similar or identical elements.

As shown in FIGS. 3 through 5, in the ink jet head 12, the electro-thermal transducers 1103 are disposed one for each ink flow passage 1108 as energy generating elements for generating energy utilized to discharge ink from the plurality of discharge ports 1101 arranged in a row onto recording medium 271, which can be of the same width as the jet head. When supplied with a driving signal, an electro-thermal transducer 1103 generates thermal energy, whereby film boiling is generated in the ink, forming a bubble in the ink flow passage 1108. An ink droplet is discharged from the discharge port 1101 as a consequence of the growth of the bubble. The heating resistors 1102, constituting the electro-thermal transducers 1103 and made of a boride, such as hafnium, or a nitride, such as tantalum, are formed on the substrate 103 made of silicon. The heating resistors 1102 are formed integrally with the interconnections made of, for example, aluminum for supplying an electric signal to the respective heating resistors 1102 by the film forming technologies. An ink receiving port 107 for introducing the ink from the ink tank (not shown) into the common liquid chamber 1106 and the orifice plate 1104 having the plurality of discharge ports 1101 corresponding to the respective ink flow passages 1108 are integrally formed with the ceiling plate 105 in which the flow passage walls 1109 for separating the plurality of ink flow passages 1108 from each other and a groove for forming, for example, the common liquid chamber 1106 for temporarily accommodating the ink supplied to the ink flow passages 1108 are formed. Polysulfone is preferably used as the material of the ceiling plate 105, the ink receiving port 107 and the orifice plate 1104. The ceiling plate 105 may also be made of other forming resin materials, such as polyether sulfone, polyphenylene oxide and polypropyrene. The heater board 104, which is constituted by substrate 103, electrothermal transducers 1103 and so on, of the ink jet head is constructed such that the portion thereof to be joined to each of the flow passage walls 1109 of the ceiling plate 105 is recessed so that the flow passage wall can be fitted into that recessed portion, as will be described later.

The structure of the ink jet unit 13 will now be described with reference to FIGS. 7 through 9.

As shown in FIG. 8, one end of a wire board 121 is interconnected to an interconnection portion of the heater board 104, while a plurality of pads 122 corresponding to the electro-thermal transducers 1103 (see FIG. 5) are provided on the other end portion of the wire board 121 to receive an electric signal from the apparatus body, whereby an electric signal is supplied to the respective electro-thermal transducers 1103 from the apparatus body.

A flat metal supporting member 123 for supporting a rear surface of the wire board 121 serves as a bottom plate of the ink jet unit 13. A pressing spring 126, having an M-shaped form, presses the common liquid chamber (see FIG. 5) at the center of its M-shape, and linearly presses the portions of the ink flow passages 1108, preferably the area near the discharge ports 1101 by its front overhanging portion 127. The heater board 104 and the ceiling plate 105 are gripped by leg portions of the pressing spring 126 which pass through holes 139 of the supporting member 123 and engage a rear surface thereof in a state wherein they are pressed to each other by the concentrated urging force of the pressing spring 126 and of the front hanging portion 127 thereof. The supporting member 123 has holes 124, 134 and 136 which respectively engage two positioning projections 152 of the ink tank 14 and heat melt retaining projections 161 and 162 of the ink tank 14. The supporting member 123 also has positioning projections 137 and 138 used for a carriage 16 on a rear surface thereof. The supporting member 123 also has a hole 125 through which an ink supply pipe 167 (described later) from the ink tank 14 can pass. The wire board 121 may be mounted on the supporting member 123 by an adhesive.

Two recessed portions 171 of the supporting member 123 are provided near the protrusions 137 and 138, respectively, so that they can be located on extensions of the distal end areas of the head formed by parallel grooves 173 and 174 in the assembled ink jet cartridge 11 to prevent unwanted material, such as dust or ink, from reaching the protrusions 137 and 138, as shown in FIG. 7. A lid member 151 on which the parallel grooves 173 are formed forms an outer wall of the ink jet cartridge, as shown in FIG. 7, as well as a space between the ink tank 14 and the lid member 151 in which the ink jet unit 13 can be accommodated. In an ink supply member 128 on which the parallel grooves 174 are formed, an ink conduit 158 connected to the ink supply pipe 167 is shaped in the form of a cantilever which is fixed at one end thereof located closer to the ink supply pipe 167. A sealing pin 130 is inserted into the ink supply member 128 to assure capillarity between the fixed side of the ink conduit 158 and the ink supply pipe 167. A packing 129 is provided to seal the gap between the ink tank 14 and the ink supply pipe 167. A filter 133 is provided at the end portion of the ink supply pipe 167 closer to the ink tank 14.

Since the ink supply member 128 is formed by molding, it is inexpensive, exhibits high positioning accuracy, and eliminates a reduction in the accuracy which would occur during manufacture. Further, since the ink conduit 158 has a cantilever structure, pressing of the ink conduit 158 against the ink receiving port 107 can be stabilized even when the ink supply member 128 is mass produced. The ink conduit 158 can be reliably connected to the ink receiving port 107 only by supplying an adhesive from the side of the ink supply member 128 in that pressed state. The ink is then supply member 128 can be fixed to the supporting member 123 by passing two pins (not shown) on the rear surface of the ink supply member 128 through the holes 135 and 163 in the supporting member 123 and then by melting the two pins in the holes. Since the melted small protruding areas on the rear surface are accommodated in a recess (not shown) on the side surface of the ink tank 14 on which the ink jet unit 13 is mounted, the positioning surface of the ink jet unit 13 can be made accurate.

The structure of the ink tank 14 will be described below.

The ink tank 14 includes a cartridge body 20, an ink absorber 150 and a lid member 153. The ink tank 14 is formed by inserting the ink absorber 150 into the cartridge body 20 from the side thereof remote from the ink jet unit 13 and then by closing the cartridge body 20 by the lid member 153.

The ink absorber 150 is made of a porous material which absorbs and retains ink. The ink absorber 150 is disposed within the cartridge body 20. The details of the ink absorber 150 will be described later. An ink supply port 154 is used not only to supply ink to the ink jet unit 13 but also to allow the ink absorber 150 to be impregnated with ink during assembly of the ink jet cartridge 11. The ink tank 14 has an air port 156 through which the air is taken into the ink tank 14. A liquid repellent material 155 is disposed inside the air port 156 in order to prevent ink leakage from the air port 156.

In this embodiment, in order to assure excellent ink supply from the ink absorber 150, an air existing area in the ink tank 14 is formed by ribs 168 of the cartridge body 20 and partial ribs 169 and 170 of the lid member 153 over the corner which is furthest from the ink supply port 154 in such a manner that it is connected to the air port 156. Hence, the ink supply from the ink support port 154 to the ink absorber 150 is excellent and uniform. This method is practically useful. The cartridge body 20 has four ribs 168 on the rearward surface thereof parallel to the direction in which the carriage (see FIG. 11) is moved. The ribs 168 prevent the ink absorber 150 from making close contact with the rearward surface of the ink tank 14. The partial ribs 169 and 170 are provided on an inner surface of the lid member 153 in correspondence with the respective ribs 168 at positions corresponding to projected positions of the ribs 168. Unlike the ribs 168, the partial ribs 169 and 170 are separated from each other and so increase the air existing space more than the ribs 168. The partial ribs 169 and 170 are dispersed on a region which is less than half the entire area of the lid member 153. The ribs enable the ink in the corner of the ink absorber 150 furthest from the ink supply port 154 to be stabilized and reliably introduced toward the ink supply port 154 due to capillary action.

The ink tank 14 has an ink accommodating space of rectangular parallelopipedal shape, and the long side of the rectangular parallelopiped is located sideways. Therefore, the above-described rib layout is particularly effective. Where the ink tank is located with its long side directed in the direction of the movement of the carriage 16 (see FIG. 11) or the ink tank has a square shape, ink supply from the ink absorber 150 can be stabilized by providing ribs on the entirety of the lid member 153. In order to accommodate as much ink as possible in a limited space, it is desirable that the ink tank have a form of rectangular parallelopiped. In that case, it is essential to provide ribs which perform the above-mentioned action on the two surfaces adjacent to the corner area in order to use the stored ink without waste, as mentioned above. Further, the ribs on the inner surface of the ink tank 14 are distributed uniformly in a direction of the thickness of the ink absorber 150 of rectangular parallelopipedal shape. This structure makes the atmospheric pressure in the entire ink absorber 150 uniform and thus enables the maximum amount of the ink in the ink absorber 150 to be consumed. Further, when an arc whose radius is equal to the long side of the rectangular parallelopiped is plotted on the upper surface thereof using, as a center thereof, the position to which the ink supply port 154 of the ink tank 14 is projected, by providing ribs on the surface outside of that arc, the portion of the ink absorber 150 located outside the arc can be placed under the atmospheric pressure at the earliest possible time. In that case, the air port 156 of the ink tank 14 can be located at any position as long as the air can be introduced into the area in which the ribs are disposed.

In addition, in this embodiment, the surface of the ink jet cartridge 11 located on the rear of the ink jet head 12 is made flat so as to minimize the space required in the apparatus to incorporate the ink jet cartridge 11 and to maximize the amount of ink stored in the ink jet cartridge 11. Consequently, the size of the apparatus can be reduced and the frequency with which the ink jet cartridge 11 must be replaced with a new one can be reduced. A protruding portion for the air port 156 is formed utilizing the rear portion of the space in which the ink jet unit 13 is provided, and that protruding portion is made hollow to form an atmospheric pressure supply space 157 over the entire thickness of the ink absorber 150. In this way, an improved ink jet cartridge which is not known can be provided. The atmospheric pressure supply space 157 has a size far greater than that of a conventional one, and the air port 156 is located in the upper portion thereof. Thus, even if ink is released from the ink absorber 150 for some unknown reason, it remains in the atmospheric pressure supply space 157, until it is taken up into the absorber 150.

FIG. 9 illustrates the structure of the surface of the ink tank 14 on which the ink jet unit 13 (not shown) is mounted. Assuming that a straight line $L_1$ passes through substantially the center of the large number of discharge ports 1101 provided in the orifice plate 1104 parallel to the bottom surface of the ink tank 14 or the reference surface of the carriage 16 on which the ink jet cartridge is mounted, the two positioning projections 152, which engage the holes 124 of the supporting member 123, are disposed on that straight line $L_1$. The projections 152, which are slightly shorter than the thickness of the supporting member 123, position the supporting member 123. A claw 165 which engages a 90° hooked surface 203 of a positioning hook 202 (see FIG. 10) of the carriage 16, is located on the extension of the straight line $L_1$ so as to allow the force with which the ink jet cartridge is positioned with respect to the carriage 16 to act on the surface area parallel to the above-mentioned reference surface containing the straight line $L_1$. As will be described later, this structure is effective because the positioning accuracy of the ink tank 14 alone is the same as the positioning accuracy of the discharge ports 1101 of the ink jet head 12. Further, the projections 161 and 162 of the ink tank 14, which respectively correspond to the fixing holes 134 and 136 provided in the supporting member 123 are longer than the projections 152, and the protruding portions from the supporting member 123 are thermally melted to fix the supporting member 123. Further, a straight line $L_3$, which is perpendicular to the straight line $L_1$ and passes the projection 161, does not coincide with a straight line $L_2$ which passes through the projection 162, and the projections 161 and 162 exist near the projection 152 located closer to the discharge ports 1101 of the ink jet head 12. Consequently, the positioning of the ink jet head 12 upon the ink tank 14 is further reinforced. A curve $L_4$ describes the outer wall position of the mounted ink supply member 128. Since the projections 161 and 162 are located along the curve $L_4$, sufficient strength and positioning accuracy relative to the weight of the distal end side of the ink jet head 12 are assured. A tab 172 at the distal end of the ink tank 14 is inserted into a hole of a front plate 201 (FIG. 7) of the carriage 16. The tab 172 is provided to cope with an abnormality in which the ink tank 14 is displaced greatly. A stopper 166 is a protective member provided relative to a bar (not shown) of the carriage 16. When the ink jet cartridge 11 is mounted, the stopper 166 below the bar maintains the mounted state of the ink jet cartridge 11 even when a force for removing the ink jet cartridge 11 in an upward direction acts thereon.

After the ink jet unit 13 is mounted on the ink tank 14, it is covered by the lid member 151. In that state, all the surfaces of the ink jet unit 13 are enclosed except for the underside thereof. Since the ink jet cartridge 11 is placed on the carriage 16, the open underside of the ink jet unit 13 is located adjacent to the carriage 16, whereby all the four surfaces of the ink jet unit 13 are substantially enclosed. Thus, when the apparatus is continuously used for a long time, the heat from the ink jet head 12 located in that enclosed space causes a slight temperature increase, which in fact may be helpful if it is desirable to keep the space warm. If too much heat is produced, then to accelerate natural heat radiation from the supporting member 123, a slit-like opening 159 is provided in the upper surface of the ink jet cartridge 11. The opening 159 has a width smaller than that of the space in which the ink jet head 12 is provided. In this way, a temperature increase is prevented, and a distribution of the temperature in the entire ink jet unit 13 can be made uniform regardless of the temperature of an external environment.

In an assembled ink jet cartridge 11, ink in the cartridge body 20 passes through the ink supply pipe 167, the ink supply port 154, the hole 125 provided in the supporting plate 123, and then an introducing port provided on the intermediate rear surface of the ink supply member 128 and is supplied into the ink supply member 128. After passing through the ink supply member 128, ink passes through the ink conduit 158 and the ink receiving port 107 of the ceiling plate 105 and flows into the common liquid chamber 106.

A packing, made of, for example, silicon rubber or butyl rubber, is disposed at each of the connecting portions of the ink flow passage to seal the ink supply passage.

Since the ink supply member 128, the ceiling plate 105, the orifice plate 1104 and the cartridge body 20 are formed as one unit, as mentioned above, assembly accuracy is increased and the quality of the mass produced products can be improved. Further, the number of parts is reduced as compared with that of the conventional apparatus. Consequently, devices having the desired excellent characteristics can be reliably obtained.

Further, in the ink jet cartridge 11 of this embodiment, a gap 160 exists between an upper surface portion 131 of the ink supply member 128 and an end portion 210 of a room portion having the opening 159 of the ink tank 14. Similarly, a gap (not shown) is formed between a lower surface portion 132 of the ink supply member 128 and an end portion 213 of a thin plate member located below the ink tank 14 and closer to the ink jet head 12 and to which the lid member 151 is adhered. These gaps further accelerate the heat radiation effect of the opening 159, and prevent an unnecessary force applied to the ink tank 14 from being applied directly to ink supply member 128 and hence the ink jet unit 13.

The above-described structures of this embodiment are not known and are unconventional, and such structures have their advantages both individually and in combination.

Next, mounting of the ink jet cartridge 11 on the carriage 16 will be described with reference to FIG. 10.

Figure 10:
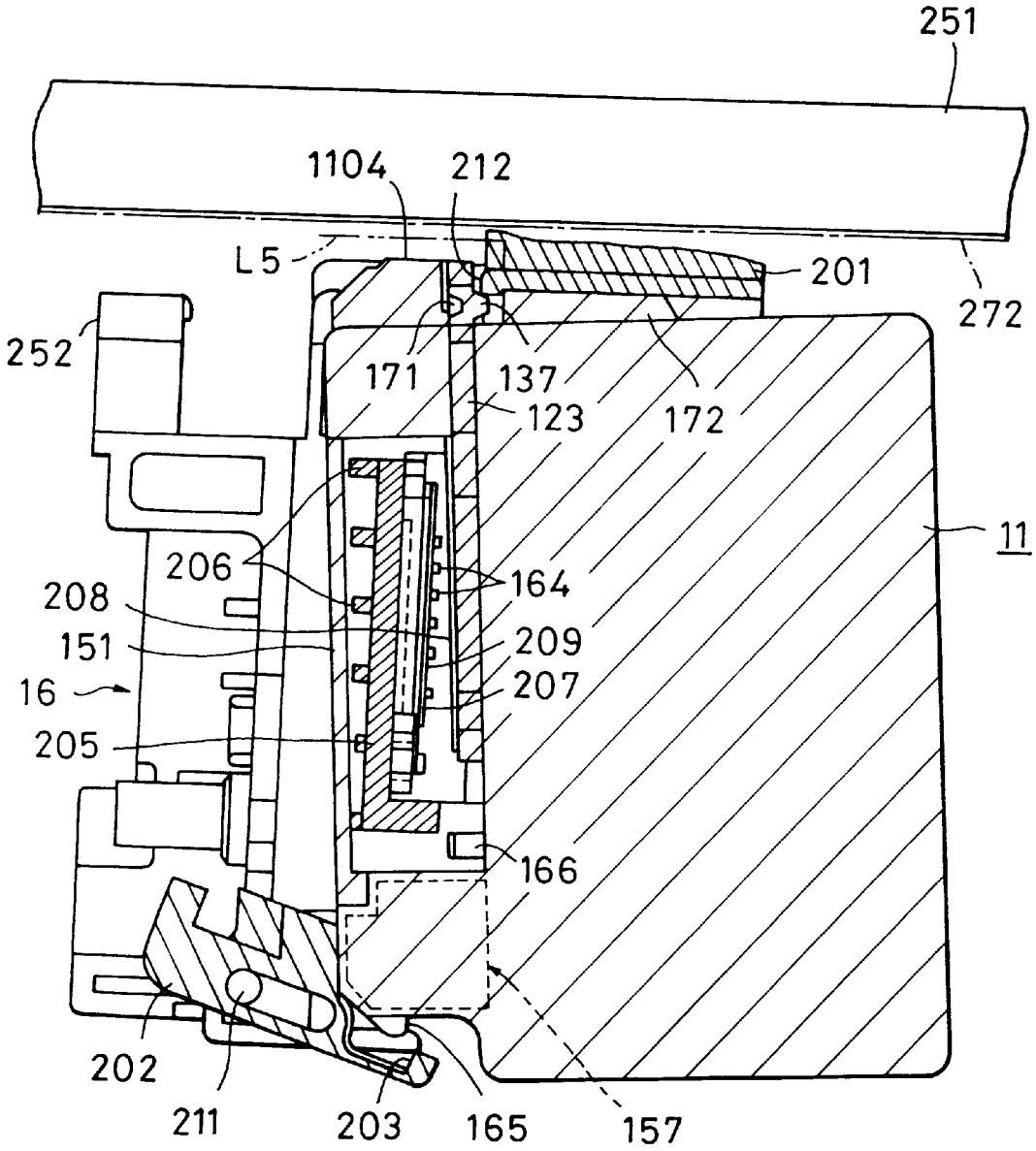
FIG. 10 illustrates a state in which the ink jet cartridge shown in FIG. 7 is mounted on a carriage.

Referring to FIG. 10, a platen roller 251 guides a recording medium 272 (which may be a sheet of recording paper) from the rear side of the figure to the front side thereof. The carriage 16 moves in the longitudinal direction of the platen roller 251, and has the front plate 201 (having a thickness of, for example, 2 mm) provided on the front of the carriage 16, i.e., on the side of the carriage 16 close to the platen roller 251 and located on the front side of the ink jet cartridge 11, a supporting plate 205 for an electric connecting portion, which will be described later, and the positioning hook 202 for fixing the ink jet cartridge 11 at a predetermined recording position. The front plate 201 has two positioning protruding surfaces 212 corresponding to the projections 137 and 138 of the supporting member 123 of the ink jet cartridge 11. After the ink jet cartridge 11 is mounted on the carriage 16, the carriage 16 is subjected to a perpendicular force directed to the protruding surfaces 212. Therefore, a plurality of reinforcing ribs (not shown) are provided on the side of the front plate 201 close to the front plate 201 against the direction of the application of the perpendicular force. The ribs slightly protrude from a front position $L_5$ of the mounted ink jet cartridge 11 toward the platen roller 251 (by, for example, about 0.1 mm) and also form head protecting protruding portions. The supporting plate 205 has a plurality of reinforcing ribs 206 which extend in a direction perpendicular to the surface of the figure. The degree to which these ribs protrude sideways decreases in a direction moving toward the hook 202 from the platen roller 251 so as to allow the ink jet cartridge 11 to be mounted slantingly, as shown in FIG. 10. The supporting plate 205 also has a flexible sheet 207 having pads 164 corresponding to the pads 122 of the wire board 121 of the ink jet cartridge 11, and a rubber pad sheet 209 for generating an elastic force which presses against the pads 164 from the rear side of the flexible sheet 207. In order to stabilize electrical contact between the pads 122 and the pads 164, the supporting plate 205 has a positioning surface 208 close to the hook 202 in correspondence with the protruding surfaces 212 to exert the acting force toward the ink jet cartridge 11 in a direction opposite to the direction of the protruding surfaces 212 to form a pad contact area between the pads and to define the amount of deformation of the pads of the rubber pad sheet 209 which faces the pads 164. The positioning surface 208 is brought into contact with the surface of the wire board 121 when the ink jet cartridge 11 is fixed at a recordable position. Since the pads 122 are distributed symmetrically with respect to the straight line $L_1$, the amount of deformation at which the pads of the rubber pad sheet 209 are deformed becomes uniform, further stabilizing the contact pressure between the pads 164 and 122. In this embodiment, the pads 122 are distributed in two rows in each of the upper and lower portions and in two rows in the vertical direction.

The hook 202 has an elongated hole which engages a fixed shaft 211. To position the ink jet cartridge 11 relative to the carriage 16, the hook 202 is pivoted counterclockwise from the position shown in FIG. 10 and then moved leftward in the longitudinal direction of the platen roller 251 utilizing the space of the elongated hole. The hook 202 shifting method is not limited to the above-described one and any method can be adopted. However, a shifting method utilizing a lever is desirable. When the hook 202 is pivoted, the ink jet cartridge 11 moves toward the platen roller 251 to a position where the positioning projections 137 and 138 can make contact with the protruding surfaces 212 of the front plate 201. As the hook 202 moves leftward, the 90 hooked surface 203 makes contact with a 90° surface of the claw 165 of the ink jet cartridge 11, the ink jet cartridge 11 turns about the contact area between the projections 137 and the protruding surfaces 212 on a horizontal plane, and finally the pads 122 and 164 make contact with each other. When the hook 202 has been retained at a predetermined position, i.e., at a fixed position, contact between the pads 122 and 164, complete contact between the projections 137 and 138 and the protruding surfaces 212, surface contact between the hooked surface 203 and the 90° surface of the claw 165, and surface contact between the wire board 121 and the positioning surface 208 are completed simultaneously, thus completing retaining of the ink jet cartridge 11 relative to the carriage 16.

The ink jet apparatus to which the present invention is applied will now be outlined.

Figure 11:
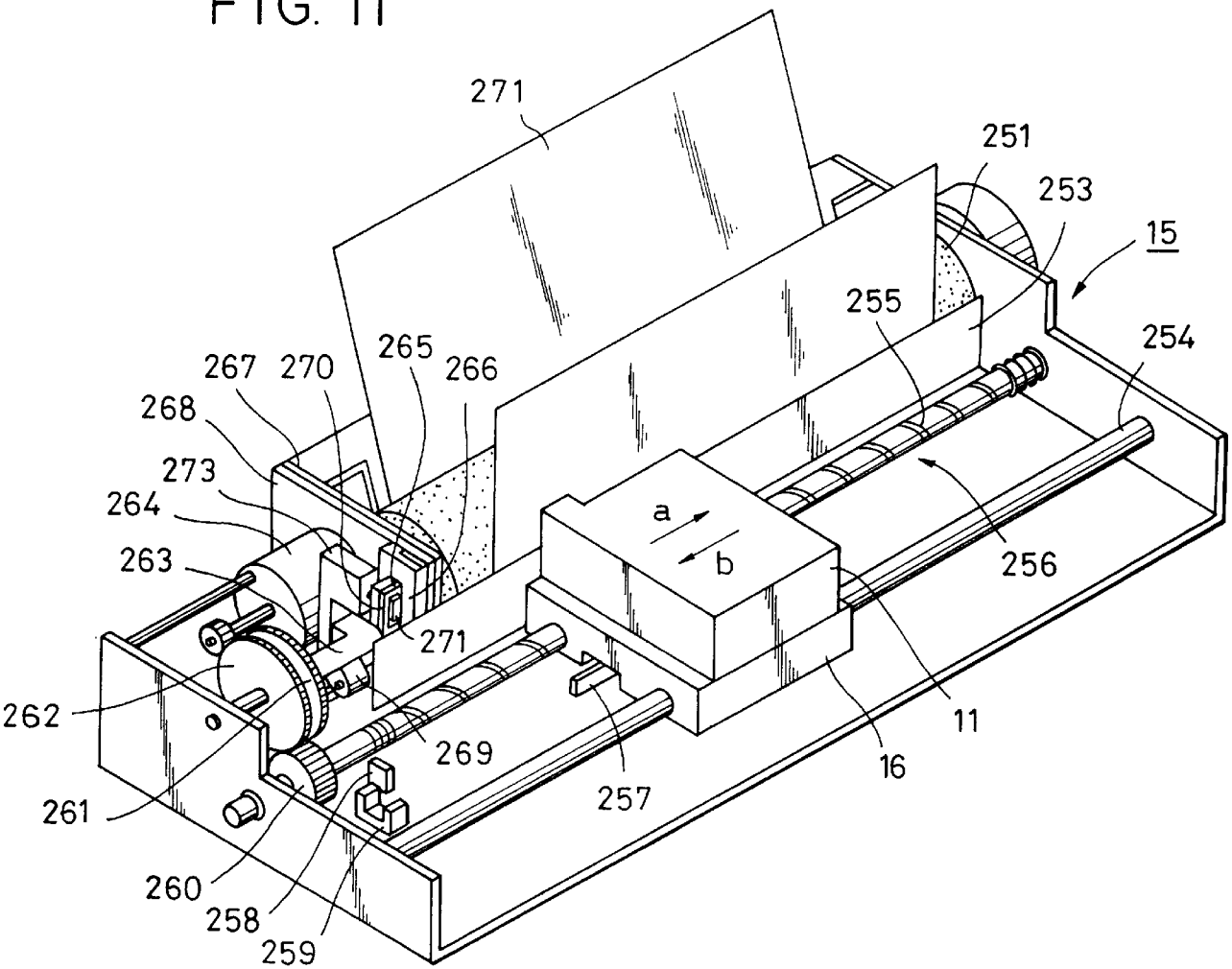
FIG. 11 is a schematic perspective view of an embodiment of an ink jet recording apparatus on which the ink jet cartridge shown in FIG. 7 is mounted.

The outline of the ink jet apparatus to which the present invention is applied is shown in FIG. 11. A lead screw 256 in which a helical groove 255 is formed is driven in two directions by a driving motor 264 through driving force transmission gears 262 and 260. The carriage 16 is brought into engagement with the helical groove 255 by a pin (not shown) provided on a mounting portion 252 (see FIG. 10), and is slidably guided by a guiding rail 254 so that it can be reciprocatively moved in directions indicated by arrows a and b in FIG. 11. A paper pressing plate 253 presses the recording medium 272 against the platen roller 251 in the direction in which the carriage 16 is moved. A photo coupler 258 and 259 constitutes home position detection means for checking the presence of the lever 257 of the carriage 16 in that area when, for example, the direction in which the driving motor 264 is rotated is to be reversed. A capping member 270 for capping the front surface of the ink jet head 12 is supported by a supporting member 265. The capping member 270 has suction means 273 to perform suction recovery of the ink jet head 12 through an in-cap opening 271. A supporting plate 268 is mounted on the apparatus body supporting plate 271, and a cleaning blade 266 is slidably supported by the supporting plate 268. The cleaning blade 266 is moved in forward and rearward directions by driving means which is not shown. The configuration of the cleaning blade 266 is not limited to the one shown but any known blade can be employed in this apparatus. A lever 263, used to initiate the suction recovery operation, moves as a cam 29 which makes contact with the carriage 16 moves, whereby the driving force from the driving motor 264 is controlled by known transmission means, such as the gear 261 and clutch switch over.

The capping, cleaning and suction recovery processes are performed at corresponding positions by the action of the lead screw 256 when the carriage 16 is at the home position region. Any known method can be employed in this embodiment as long as a desired operation can be performed at a known timing.

The major components of the present invention will be described.

The heater board of the ink jet head according to the first embodiment of the present invention will now be described with reference to FIGS. 5 and 6.

After an insulating layer 1111 of an inorganic material (e.g., SiO, $SiO_2$ or SiN) (in this embodiment, $SiO_2$) is formed on the substrate 103 by a known film forming technique (in this embodiment, sputtering is used), a portion of the insulating layer 1111 is removed in a form shown in FIG. 6 by etching which employs a solvent of, for example, antimony fluoride to form a recessed shape 1117 to which the flow passage walls 1109 of the ceiling plate 105 are brought into contact. An end portion of the recessed shape 1117 is tapered in order to prevent deterioration of a thin film formed on the shoulder portion of the insulating layer 1111. Thereafter, a first interconnection layer (not shown) of the two-layer interconnection is formed on the insulating layer 1111, and then an interlayer insulator 1112 ($SiO_2$), a resistor layer 1102 ($HfB_2$), an interconnection layer 1110 (Al), a first protective layer 1113 ($SiO_2$), a second protective layer 1114 (Ta) and so on are formed, whereby the heater board is completed.

In this embodiment, a contact surface 1119 on the heater board to which the lower end portion of each of the flow passage walls 1109 of the ceiling plate 105 is brought into contact is formed in the recessed region 1117. Therefore, where the aligned heater board and the ceiling plate 105 are brought into close contact and fixed to each other using an elastic member, such as a plate spring, the flow passage wall 1109 does not shift out of position due to the recessed portion 1117. Further, since the contact portion between the heater board and the flow passage wall 1109 is disposed lower than a heat acting surface 1116 which is a surface portion along which heat is supplied to the ink from the electro-thermal transducer 1103 (in this invention, the direction directed to the substrate 103 is expressed as low for convenience and does not indicate an actual downward direction), even if a small gap is generated between the contact surface 1119 of the heater board and the lower end portion of the flow passage wall 1109 of the ceiling plate, the pressure wave generated by bubbling does not readily propagate to the adjacent ink flow passage, thus greatly reducing bubbling energy loss.

Further, in a conventional head in which the substrate and the flow passage wall are not adhered together, when the temperature increases due to continuous discharge, the ceiling made of a resin expands relative to the substrate made of, for example, silicon due to a difference in the coefficient of thermal expansion between the ceiling plate and the substrate. Thus, where the initial alignment accuracy between the ceiling plate and the substrate is not good, the flow passage wall 1109 may shift on the heat acting surface of the heater board. However, in the present invention, even if expansion of the ceiling plate occurs, the edge of the flow passage wall 1109 strikes the inclined surface of the recessed portion 1117, as shown in FIG. 6, and does not rise on the flow passage wall 1109.

The recessed region formed in this embodiment may be provided on the entire region where the flow passage wall is brought into contact with the heater board or near the heat acting portion above the heating resistor. In the latter case, the flow passage wall is fitted to that recessed portion.

Figure 12A:
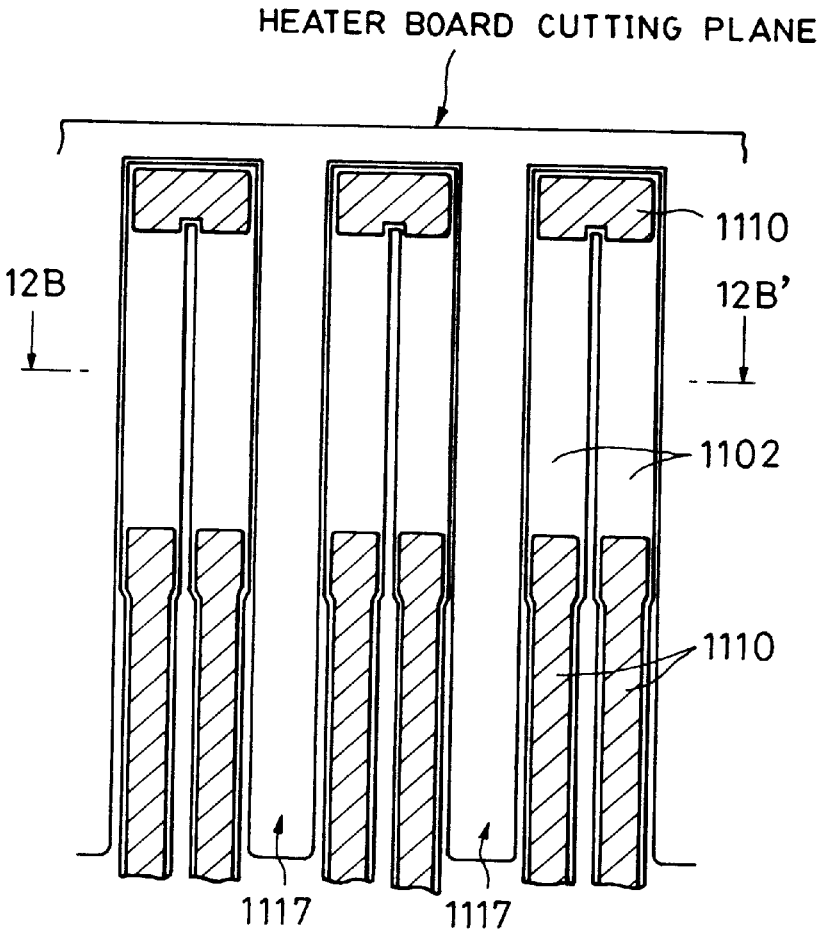
FIGS. 12(A) and 12(B) are a schematic plan views showing a heater board according to a second embodiment of the present invention.
Figure 12B:
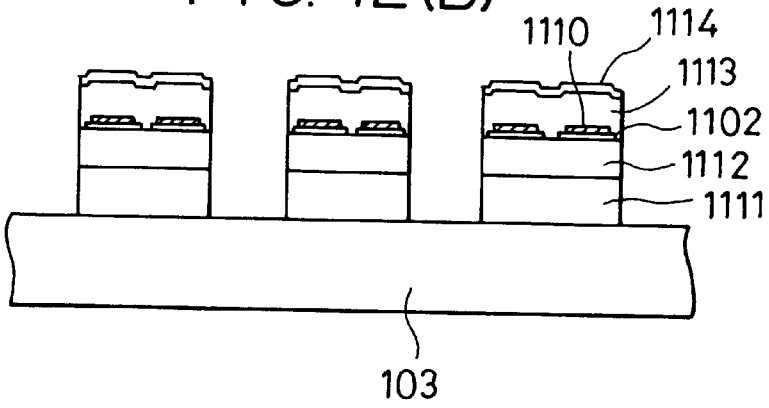

FIG. 12(A) is a plan view of the heater board according to a second embodiment of the present invention. FIG. 12(B) is a cross-section taken along the line 12B–12B' of FIG. 12(A). Reference numerals in these figures which are the same as those in FIGS. 5 and 6 represent similar or identical elements, and description thereof is thus omitted.

In this embodiment, patterns of films are formed by the known film-forming and etching technologies in the same manner as that of the first embodiment. In this embodiment, since the two heating resistors 1102 are series-connected to each other in the single ink flow passage, the heater board can be formed without disposing the interconnection 1110 in the joining portion of the flow passage wall. Consequently, the recessed portion on the heater board can be formed deeper, and release of the bubbling energy to the adjacent ink flow passages can be further restricted by making such a deep recessed portion the joining portion. As a result, stable discharge can be performed, and excellent recording at a fixed dot diameter can be performed.

Where the heater board (substrate) manufactured in the manner described above is joined to the ceiling plate, if the ceiling plate and the heater board are misaligned with each other, the positional relation between the energy generating element and the flow passage is misaligned, thus reducing the ink discharge accuracy. To prevent this, it has been proposed to align the energy generating elements with the discharge ports by measuring the position of the energy generating elements on the substrate on an image obtained by, for example, a TV camera and then by measuring the position of the ceiling plate mounted on a predetermined movable stage while moving the ceiling plate on an image.

However, the above-described method requires measurement of the position of the energy generating element and the position of the discharge ports, thus increasing the production costs of the manufacturing apparatus.

Further, a sequence of operations, consisting of measurement of the position of the discharge ports, the movement of the ceiling plate to a desired position and the measurement of the position of the discharge ports again, must be repeated until any deviation from the desired position falls in a predetermined allowance. Thus, it takes a relatively long time for positioning to be done, thus relatively increasing production cost.

Hence, the present inventors intensively studied and found both a method of and an apparatus for manufacturing ink jet heads which enables alignment between a heater board and a ceiling plate to be readily performed without requiring a large-scale apparatus and without changing the configuration of the ink jet head.

More specifically, the present invention provides a method of manufacturing an ink jet head, including a substrate on which a plurality of energy generating elements for generating energy utilized to discharge ink are provided, and a wall member joined to the heater board and having a plurality of flow passage walls which can form flow passages through each of which the energy generated by the energy generating element is caused to act on the ink to discharge the ink, the flow passages being formed by joining the heater board to the wall member, the method being characterized in that a recessed portion which is fitted to each of the flow passage walls is provided in the heater board, and in that the recessed portions are brought into engagement with the flow passage walls by causing a force to act on the wall member in a direction in which the plurality of energy generating elements are arranged to align the flow passages with the energy generating elements.

Further, the prevent invention provides a method of manufacturing an ink jet head including a heater board on which a plurality of energy generating elements for generating energy utilized to discharge ink are provided, and a wall member joined to the heater board and having a plurality of flow passage walls which can form flow passages through each of which the energy generated by the energy generating element is caused to act on the ink to discharge the ink, the flow passages being formed by joining the heater board to the wall member. The method is characterized in that a recessed portion which is fitted to each of the flow passage walls is provided in the heater board, and in that the recessed portions are brought into engagement with the flow passage walls by vibrating the heater board in a state where a force having at least a component in a direction in which the plurality of energy generating elements are arranged acts on the wall member to align the flow passages with the energy generating elements.

Further, an apparatus for manufacturing an ink jet head including a heater board on which a plurality of energy generating elements for generating energy utilized to discharge ink are provided, and a wall member joined to the heater board and having a plurality of flow passage walls which can form flow passages through each of which the energy generated by the energy generating element is caused to act on the ink to discharge the ink, a recessed portion which is fitted to each of the flow passage walls being formed in the heater board, the flow passages being formed by bringing the flow passage walls into engagement with the recessed portions, the apparatus comprising retaining means for retaining the heater board in which the recessed portions are provided, placing means for placing the wall member on the heater board retained by the retaining means in such a manner that the recessed portions oppose the flow passage walls, pressing means for causing a force having at least a component in a direction in which the plurality of energy generating elements are arranged to act on the wall member placed by the placing means in a state wherein the wall member is stacked on the heater board, and vibration means for vibrating the heater board in a state wherein the component in the direction of the arrangement by the pressing means is acting.

In the above-described structures, even if accurate alignment is not achieved when the ceiling plate is joined to the heater board, the flow passage walls of the ceiling plate enter the recessed portions provided in the heater board because of the force exerted in a direction in which the energy generating elements are arranged to act on the ceiling plate.

The method of and the apparatus for manufacturing ink jet heads will be described in further detail with reference to FIG. 13 to FIG. 15.

Figure 13:
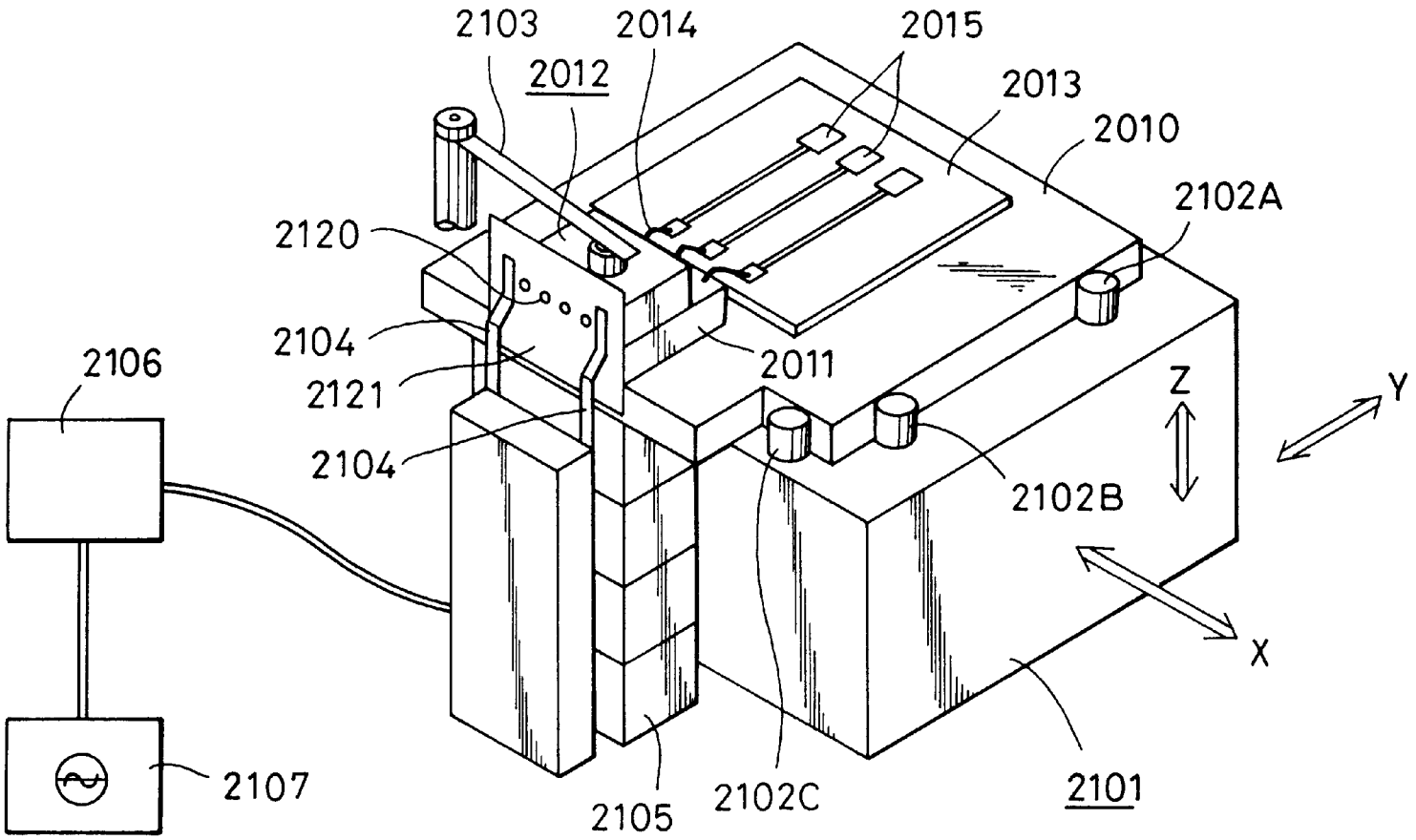
FIG. 13 is a schematic perspective view illustrating an ink jet head manufacturing apparatus for manufacturing ink jet heads.

FIG. 13 illustrates an ink jet head manufacturing apparatus for manufacturing an ink jet head according to the present invention.

In the figure, reference numeral 2010 denotes a base plate which is a structural material of the ink jet head. Onto this plate are joined, by means of an adhesive, a substrate 2011 on which a plurality of energy generating elements (not shown) are provided and a circuit board 2013 for electrical wiring. The interconnections on the substrate 2011 and the wiring on the circuit board 2013 are electrically connected to each other by wire bonding 2014.

Reference numeral 2012 denotes a ceiling plate in which an ink supply port, a common liquid chamber, grooves for forming ink flow passages and an orifice plate 2121 are formed as one unit by molding. Discharge ports 2120 are formed in the orifice plate 2121 using a laser.

The procedures of alignment between the ceiling plate 2012 and the substrate 2011 when the ink jet head having the above-described structure is manufactured in the manufacturing apparatus will now be described.

First, the substrate 2011 on which the heat energy generating elements are provided as the energy generating elements and the circuit board 2013 are adhered using an adhesive. Next, the substrate 2011 and the circuit board 2013 are electrically connected to each other by means of, for example, wire bonding to prepare the substrate of the ink jet head.

Thereafter, the base plate 2010 is placed on a receptor jig 2101 of the manufacturing apparatus. At that time, part of the front portion of the base plate 2010 (the portion on which the substrate 2011 is joined) is placed on a piezoelectric element 2105.

The base plate 2010 placed on the jig 2101 and the piezoelectric element 2105 is pressed in X and Y directions by a pressing mechanism (not shown) until part of the base plate 2101 makes abutment with pins 2102A, 2102B and 2102C on the jig 2101.

Next, the base plate 2010 is pressed in Z direction and fixed on the jig 2101 by a pressing mechanism which is not shown, whereby the front portion of the base plate 2010 is pressed against and fixed to the piezoelectric element 2105 while the rear portion thereof is pressed against and fixed to the receptor jig 2101.

Thereafter, the ceiling plate 2012 is supplied onto the substrate 2011 on the base plate 2010. This supply is performed by making an automatic manipulator (not shown) retain the ceiling plate 2012 arranged on, for example, a tray (not shown) and by moving the retained ceiling plate 2012 onto the substrate 2011.

Subsequently, the upper portion of the ceiling plate 2012 (the top of the ink supply port in the case of this embodiment) is pressed by a spring 2103. At that time, the spring 2103 does not press the top of the ink supply port from above but presses the ink supply port in such a manner that it makes contact with the outer edge of a circumference formed by the top, as shown in FIG. 14(*c*). In this way, the pressing force of the spring 2103 is divided into a force F'1 in a direction perpendicular to the substrate 2011 (Z direction) and a force F'2 in a direction in which the energy generating elements are arranged on the substrate 2011 (X direction).

Thereafter, the front surface of the orifice plate 2121 of the ceiling plate is pressed by two plate springs 2104 located in front of the ink jet head so that the orifice plate 2121 can be pressed against the front edge surface of the substrate 2011, whereby the ceiling plate 2012 is positioned relative to the substrate 2011 in the direction of discharge.

At that time, the discharge ports 2120 and the energy generating elements have either of following two types of positional relationships. That is, as shown in FIG. 14(*a*), walls 2012*a*, which form ink flow passages corresponding to the respective discharge ports 2120, may be on the acting surfaces (the heat acting surface) on energy generating elements 2011*a* or in recessed portions 2011*d* between the energy elements, as shown in FIG. 14(*b*).

Figure 14:
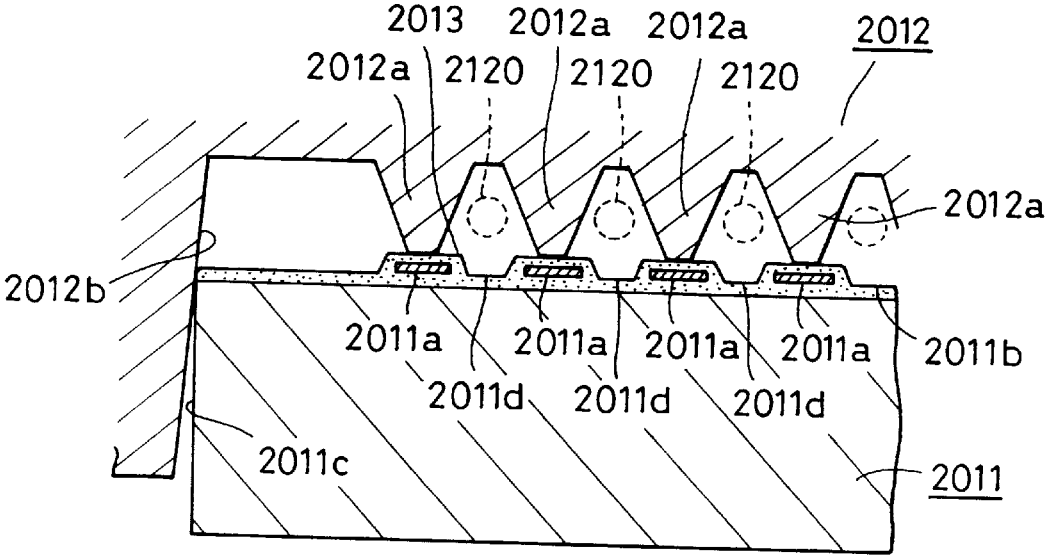
FIGS. 14(*a*) and 14(*b*) are respectively cross-sectional views schematically illustrating two examples of a state in which a ceiling plate is placed on a substrate.
Figure 14:
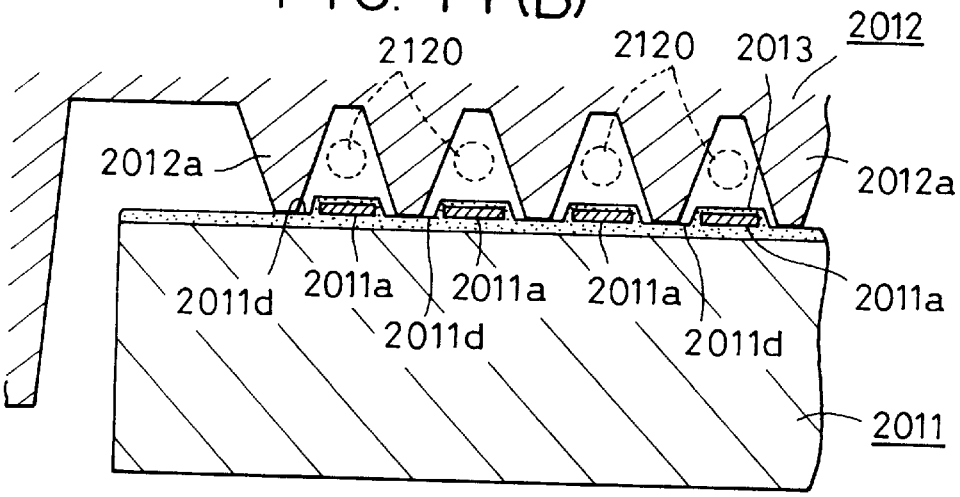
Figure 14:
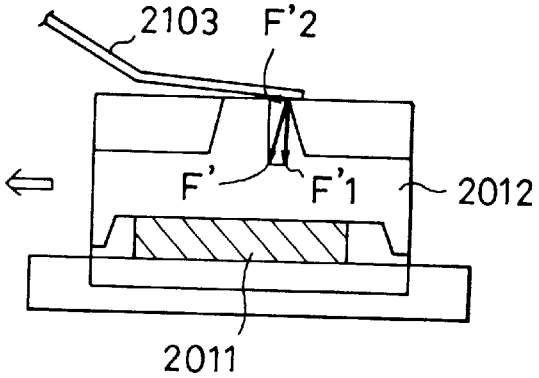

The state wherein the walls 2012*a* are in the recessed portions 2011*d* between the energy generating elements, as shown in FIG. 14(*b*), is a state in which the energy generating elements 2011*a* are in proper alignment with the discharge ports 2120. In other words, when the walls 2012*a* are disposed on the energy generating elements, as shown in FIG. 14(*a*), alignment is performed by shifting the ceiling plate 2012 in any way and thereby dropping the walls 2012*a* in the recessed portions 2011*d* between the energy generating elements, as shown in FIG. 14(*b*).

Hence, in this embodiment, the substrate 2011 is vibrated by applying a signal to the piezoelectric element 2105 with which the bottom surface of the front portion of the base plate 2010 is contact. The signal applied to the piezoelectric element is obtained by adding a bias voltage to a signal obtained by amplifying the signal (rectangular waves of about 5 KHz in this embodiment) generated by an oscillator 2107 by an amplifier 2106. When applied with the signal, the piezoelectric element vibrates at an amplitude of about 1 $\mu$m.

Although the component force F'2 is acting on the ceiling plate on the substrate 2011 in a direction (X direction) in which the energy generating elements are arranged, as shown in FIG. 14(*c*), so long as no vibration is applied, the ceiling plate 2012 remains stationary due to a static frictional force which acts between the ceiling plate and the substrate by the component F'1 in the direction (Z direction) perpendicular to the substrate. However, when vibrations are applied to the ceiling plate 2012 and the substrate 2011 in the manner described above, the frictional force by the component F'1 varies, and the ceiling plate 2012 moves relative to the substrate 2011 in X direction, i.e., in a direction indicated by an arrow in FIG. 14(*c*), by the component F'2.

Accordingly, the walls 2012*a* of the ceiling plate 2012 enter the recessed portions 2011*d* between the energy generating elements. When the ceiling plate 2012 moves, it may move throughout the gap between the recessed portion and the wall 2012*a*. However, the wall 2012*a* does not rise on the subsequent energy generating element, because the amplitude of vibrations is smaller than the depth of the recessed portion.

Although the time during which vibrations are applied differs depending on the conditions including the amplitude and frequency of vibrations and the position and elastic force of the spring 2103, it is about 1 second in this embodiment. The vibration application time can be made longer than this time because the ceiling plate and the substrate do not shift after seating even if the ceiling plate is vibrated excessively.

When alignment between the energy generating elements and the discharge ports (the ink flow passages) is completed, application of the vibrations is suspended, and the ceiling plate 2012 and the substrate 2011 are fixed to each other using an adhesive or a presser bar plate.

In the above embodiment, the ceiling plate arranged on a tray is picked up and placed on the substrate by means of the automatic manipulator. In the case of an ink jet head in which nozzles are arrayed at a high density, a deviation of the ceiling plate placed on the substrate in X direction may reach a pitch of the discharge ports (50 through 100 μm) due to a deterioration in the accuracy of the external shape of the ceiling plate or a deviation of the position of the ceiling plate on the tray. In that case, the energy generating elements may be misaligned with the discharge ports (the ink flow passages) by about ± a pitch of the discharge ports.

Hence, after the ceiling plate has been supplied by the automatic manipulator, an inner wall 2012*b* of the ceiling plate 2012 is brought into abutment with a side surface 2011*c* of the substrate 2011 by pressing the side surface of the ceiling plate by a mechanism (not shown), as shown in FIG. 14(*a*). The positional accuracy between the inner wall 2012*b* of the ceiling plate 2012 and the discharge port formed in the ceiling plate is about several μm or less because the same spacer is employed in the mold. The positional accuracy between the side surface 2011*c* of the substrate 2011 and the energy generating element is determined by the cutting accuracy with which the substrate is cut out from a wafer, and is about 10 μm. Therefore, when the inner wall 2012*b* of the ceiling plate is brought into abutment with the side surface 2011*c* of the substrate, the ceiling plate can be placed on the substrate with an accuracy of 20 to 30 μm, and alignment can thus be performed while maintaining a predetermined relation between the energy generating elements and the discharge ports (the ink flow passages).

Figure 15A:
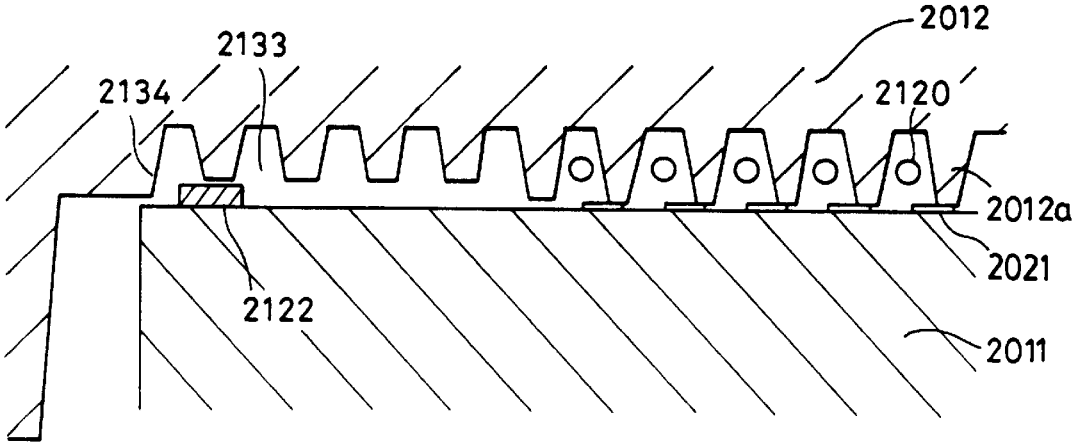
FIGS. 15(*a*) and 15(*b*) respectively illustrate the positional relation between a lip and a ceiling plate dummy nozzle wall in the ink jet head according to the present invention.
Figure 15B:
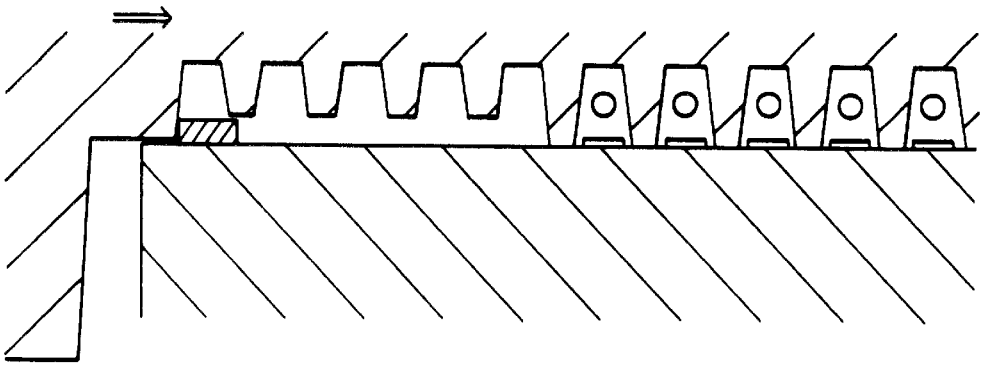

Alternatively, as shown in FIGS. 15(A) and 15(B), alignment between the energy generating elements and the nozzles may be performed simply by providing a lip on an end portion 2122 of the plurality of energy generating elements on the substrate and by bringing a dummy nozzle wall portion 2134 formed on the ceiling plate into abutment with the lip. In this case, the lip (pattern) is basically formed on the substrate such that it can abut against the dummy nozzle wall 2134 formed at the end of the nozzle row in the ceiling plate. The lip may be manufactured by forming and patterning a protective film, energy generating elements, interconnections, a protective film and a cavitation resistant film on the substrate. Alternatively, the convex pattern may be formed in a separate process. The lip has a shoulder of 1 μm preferably, with more preferable shoulder being 5 μm or above. Although the lip may also be formed by means of, for example, screen printing, the most preferable method is the photolithographic process because the photolithographic process assures a high degree of accuracy and an excellent rectangular cross-section.

In the ceiling plate, since the dummy nozzle portion can be formed at the same high accuracy as that of the nozzle pitch, the energy generating elements can be aligned with the ink discharge ports at a high degree of accuracy by bringing the nozzle wall 2134 into abutment with the lip 2122 formed on the substrate. FIG. 15 illustrates the positional relation between the lip and the ceiling plate dummy nozzle wall. FIG. 15(*a*) illustrates the positional relation between the substrate 2011 and the ceiling plate, obtained when the ceiling plate is just placed on the substrate. In the state shown in FIG. 15(*a*), the energy generating elements 2021 formed on the substrate are not in alignment with the ink discharge ports 2120 formed in the ceiling plate. The side wall of the lip 2122 formed on the substrate is brought into abutment with a side wall 2134 of the ceiling plate dummy nozzle by moving the ceiling plate sideways, as shown in FIG. 15(*b*), and the energy generating elements can thus be brought into alignment with the ink discharge ports. Nozzle walls of dummy nozzles 2133 which are not used for abutment are dimensioned such that they do not make contact with the lip.

The lip may be formed on the substrate when any of or a plurality of a heat storage layer, an energy generating element layer, an interconnection layer, a protective film layer and a cavitation resistant layer are patterned. In this case, the lip can be formed without increasing production cost. In the formation of the lip by the above method, alignment accuracy between the respective layers and the process conditions required to reduce the taper of the cross-section must be made adequate.

The lip 2122 may also be formed by a separate process. A pattern coating method, such as screen printing, may be employed as the lip method. Alternatively, a metal film separately formed on the cavitation resistant layer may be patterned by the photolithographic process. The most desirable lip forming method is the method of forming the pattern using a photosensitive resin. Examples of the photosensitive resin are a positive type photoresist which is a mixture of a novolak resin and naphthoquinone diazido derivative, a negative type photoresist composed of an acrylic resin having an unsaturated double bond and a photosensitive agent, a negative type resist composed of a rubber resin and a diazido compound, a negative type resist which is a mixture of an epoxy resin and onium salt and a silicone type resist.

Among the above-mentioned photosensitive resins, a resist composed of an epoxy resin and onium salt and a silicone type resist are the most desirable because they exhibit high alkali ink resistance.

More preferably, the lip is formed by forming a resin layer made of polysulfone or polyether sulfone exhibiting high ink resistance, by patterning a silicone type resist on the resin layer and then by patterning the resin layer by oxygen plasma using the resist as a mask. In this method, an excellent lip can be formed using a material exhibiting high ink resistance.

The present invention offers an excellent effect when it is applied to an ink jet recording method, particularly, an ink jet recording head or apparatus of the type which is provided with means (e.g., electro-thermal transducers or a laser beam) for generating heat energy as the energy utilized to discharge ink and which is designed to cause changes in the state of the ink by the heat energy, because such an ink jet recording process assures high density and high definition of recording.

Preferable configurations and principles of such ink jet heads or apparatuses are described in, for example, U.S. Pat. Nos. 4,723,129 and 4,740,796. Although this ink jet process can be applied to both on-demand type and continuous type, it is preferable for it to be applied to the on-demand type devices. In the on-demand type recording head, at least one driving signal for generating a rapid increase in the ink temperature to a value exceeding the nucleate boiling temperature of ink is applied in response to recording information to each of the electro-thermal transducers, which are disposed in such a manner that they respectively correspond to the ink holding sheets or flow passages, so as to generate thermal energy and thereby cause film boiling to occur on the heat acting surface of the ink jet head. Bubbles are thereby formed in the liquid (ink) in one-to-one correspondence with the driving signals applied to the electro-thermal transducers. The ink is ejected from the discharge outlet by virtue of the growth and contraction of the bubble to form at least one droplet. At that time, the use of a driving signal having a pulse-like form is preferred because the pulse-like driving signal causes the bubble to grow and contract instantaneously and adequately, and ink can therefore be ejected in excellent response. Driving of the recording head by means of a pulse-like signal has been proposed in, for example, U.S. Pat. Nos. 4,463,359 and 4,345,262. If the conditions described in U.S. Pat. No. 4,313,124, which involves an increase in the temperature of the heat acting surface of the ink jet head, are adopted, even better recording is possible.

The present invention can be applied to an ink jet head of the type in which the discharge ports, the liquid passages (linear or bent) and the electro-thermal transducers are provided in one-to-one-correspondence, like those disclosed in the aforementioned references. The present invention can also be applied to a recording head in which the heat acting surface is disposed in a bent area, like those disclosed in U.S. Pat. Nos. 4,558,333 and 4,459,600.

The application of the present invention to a full-line type ink jet head is particularly effective, because in the full-line type ink jet head the discharge ports are arranged over a length corresponding to the maximum width of the recording medium on which the ink jet apparatus can record and hence the influence of the aforementioned heat expansion can thus be reduced. Such a recording head may be constructed by combining a plurality of ink jet heads to fulfil the length corresponding to the maximum recording medium width or as a single ink jet head unit.

The serial type recording head to which the present invention can be applied may be of the type which is fixed to the apparatus body, of the chip type which is replaceable and which accomplishes electrical and ink supply connections to the apparatus body by the mounting thereof on the apparatus body, or of the cartridge type in which an ink tank is integrally formed with the ink jet head.

Preferably, ink jet head discharge recovery means and auxiliary means may be incorporated in the ink jet apparatus according to the present invention for the purpose of ensuring more stable recording. Suitable examples of such means include a capping means, a cleaning means, a pressurizing or suction means for the ink jet head, a preliminary heating means which employs the electro-thermal transducers, other heating elements or a combination of the electro-thermal transducers and other heating elements, and a preliminary discharge means for performing discharge for purposes other than recording an image.

The above-described ink jet apparatus according to the present invention may be of the type which incorporates a single ink jet head corresponding to a single ink color or of the type which incorporates a plurality of ink jet heads respectively corresponding to a plurality of different recording colors or densities. That is, the present invention can also be applied not only to an ink jet apparatus having a single recording mode in which recording is performed in only a single major color, such as black, and but also to an apparatus having at least one recording mode selected from both a recording mode in which recording is performed in a plurality of different colors and a recording mode in which recording is performed in a full color obtained by mixing colors. In the latter apparatus, the ink jet head may be constructed as a single unit or by combining a plurality of ink jet heads.

In the above-described embodiments, the ink has been described as liquid ink. However, an ink which is in solid form at or below room temperature and which softens or is liquid at room temperatures, may also be used. Alternatively, an ink which becomes in liquid from when a recording signal is applied may also be used because control of the temperature of the liquid used in the ink jet process generally ranges from 30° C. to 70° C. so as to adjust the viscosity of the ink to a predetermined range which ensures stable ejection. A solid ink which is normally in a solid form and liquefied by heating may also be used for the purpose of preventing an increase in the temperature by virtue of heat energy by utilizing the heat energy as an energy required to change the condition of the ink from a liquid form to a solid form or of preventing evaporation of the ink. In any way, an ink which is liquified by the presence of thermal energy, such as that which is liquefied in response to a recording signal and is ejected in the form of liquid ink or that which is liquefied in response to a recording signal but starts solidifying when it reaches the recording medium, may also be used.

The present invention can also be applied to an ink jet apparatus which is used as an image output terminal for the information processing equipment, such as a computer, a copying machine combined with, for example, a reader, or a facsimile apparatus having a transmission/reception function.

The present invention can also be applied to a textile printing machine designed to perform recording (printing) by discharging ink onto a cloth using the ink jet head according to the present invention.

What is claimed is:

1. An ink jet head having a plurality of flow passages, comprising:

a heater board, including a substrate, and an insulating layer disposed on the substrate, and a plurality of energy generating elements for generating energy utilized to discharge an ink disposed on the insulating layer, said plurality of energy generating elements being arranged in an arrangement direction, said heater board having a heat acting surface and a recessed portion formed by removing a part of the insulating layer;

a ceiling plate joined to said heater board, said ceiling plate having a plurality of grooves defining a plurality of flow passage walls which partially define the flow passages, the energy generated by said energy generating elements acting through said flow passages so as to act on the ink to discharge the ink, said flow passages being fully-defined by said heater board joined to said ceiling plate; and an elastic member having a pressing force, said elastic member pressing said heater board and said ceiling plate together so that said heater board and said ceiling plate are fixed to one another by the pressing force of said elastic member, so that each of said flow passages is thereby fully defined, wherein said recessed portion of said heater board is disposed between adjacent said energy generating elements, said recessed portion having a bottom surface located at a position which is lower than a position of the heat acting surface of said heater board along which heat is transmitted to the ink, said flow passage walls of said ceiling plate abutting said heater board at said bottom surface.

2. The ink jet head according to claim 1, wherein said ink jet head is a full line head and further comprises a plurality of discharge ports for discharging the ink, and said discharge ports are disposed over an entire recordable area.

3. The ink jet head according to one of claims 1 and 2, wherein each of said energy generating elements comprise an electro-thermal transducer which causes the heat energy to act on the ink to generate a bubble so that the ink is discharged as a result of growth of the bubble.

4. The ink jet head according to claim 1, further comprising a raised lip disposed on a surface of said heater board at an end portion thereof in the arrangement direction in which said plurality of energy generating elements are arranged, and wherein said ceiling plate has a recessed portion corresponding to said lip.

5. The ink jet head according to claim 4, wherein said recessed portion of said ceiling plate is provided within a dummy nozzle portion.

6. The ink jet head according to claim 4, wherein said lip is made of at least one of an epoxy and a silicone photosensitive material.

7. An ink jet apparatus comprising:

an ink jet head having a plurality of flow passages, a heater board, including a substrate, and an insulating layer disposed on the substrate, and a plurality of energy generating elements for generating energy utilized to discharge an ink disposed on the insulating layer, said plurality of energy generating elements being arranged in an arrangement direction, said heater board having a heat acting surface and a recessed portion formed by removing a part of the insulating layer, and a ceiling plate joined to said heater board, said ceiling plate having a plurality of grooves defining a plurality of flow passage walls which partially define the flow passages, the energy generated by said energy generating elements acting through said flow passages so as to act on the ink to discharge the ink, said flow passages being defined by said heater board joined to said ceiling plate, and an elastic member having a pressing force, said elastic member pressing said heater board and said ceiling plate together so that said heater board and said ceiling plate are fixed to one another by the pressing force of said elastic member, so that each of said flow passages is thereby defined; and driving signal generation means for generating signals for driving said energy generating elements of said ink jet head, wherein said recessed portion has a surface located at a position which is lower than a position of the heat acting surface of said heater board along which heat is transmitted to the ink, said flow passage walls of said ceiling plate abutting said heater board at said surface of said recessed portion.

8. An ink jet head having a plurality of flow passages, comprising:

a heater board, including a substrate, and an insulating layer disposed on the substrate and having a recessed portion, and a plurality of energy generating elements for generating energy utilized to discharge an ink disposed on the insulating layer, said plurality of energy generating elements being arranged in an arrangement direction, said heater board which surface has a heat acting surface and a recessed portion formed on the basis of said recessed portion;

a ceiling plate joined to said heater board, said ceiling plate having a plurality of grooves defining a plurality of flow passage walls which plurality define the flow passages, the energy generated by said energy generating elements acting through said now passages so as to act on the ink to discharge the ink, said flow passages being fully-defined by said heater board joined to said ceiling plate; and an elastic member having a pressing force, said elastic member pressing said heater board and said ceiling plate together so that said heater board and said ceiling plate are fixed to one another by the pressing force of said elastic member, so that each of said flow passages is thereby fully defined, wherein the recessed portion on the surface of said heater board is disposed between adjacent said energy generating elements, said recessed portion having a bottom surface located at the position which is lower than a position of the heat acting surface of said heater board along which heat is transmitted to the ink, said flow passage walls of said ceiling plate abutting said heater board at said bottom surface.

9. An ink jet head having a plurality of flow passages, comprising:

a heater board, including a substrate, and an insulating layer disposed on the substrate, and a plurality of energy generating elements for generating energy utilized to discharge an ink disposed on the insulating layer, said plurality of energy generating elements being arranged in an arrangement direction, said heater board having a heat acting surface and a recessed portion formed on the surface of heater board;

a ceiling plate, which is made of resin, joined to said heater board, said ceiling plate having a plurality of grooves defining a plurality of flow passage walls which partially define the flow passages, the energy generated by said energy generating elements acting through said flow passages so as to act on the ink to discharge the ink, said flow passages being fully-defined by said heater board joined to said ceiling plate; and an elastic member having a pressing force, said elastic member pressing said heater board and said ceiling plate together so that said heater board and said ceiling plate are fixed to one another by the pressing force of said elastic member, so that each of said flow passages is thereby fully defined, wherein said recessed portion of said heater board is disposed between adjacent said energy generating elements, said recessed portion having a bottom surface located at the position which is lower than a position of the heat acting surface of said heater board along which heat is transmitted to the ink, said flow passage walls of said ceiling plate abutting said heater board at said bottom surface.

* * * * *

UNITED STATES PATENT AND TRADEMARK OFFICE

CERTIFICATE OF CORRECTION

PATENT NO. : 5,992,981

DATED : November 30, 1999

INVENTOR(S) : HIROSHI SUGITANI ET AL.

It is certified that error appears in the above-identified patent and that said Letters Patent is hereby corrected as shown below:

ON THE COVER PAGE AT [75] INVENTORS

"Masashimurayama;" should read --Musashimurayama;--.

ON THE COVER PAGE AFTER [73] ASSIGNEE

Insert "[*] Notice: This patent issued on a continued prosecution application filed under 37 CFR 1.53(d), and is subject to the twenty year patent term provisions of 35 U.S.C. 154(a)(2).--

COLUMN 2

Line 63, "substrate" should read --heater board--;
Line 65, "substrate" should read --heater board--.

COLUMN 3

Line 1, "substrate" should read --heater board--;
Line 3, "substrate" should read --heater board--;
Line 6, "having a" should be deleted--;
Line 8, "substrate" should read --heater board--;
Line 9, "substrate" should read --heater board--;
Line 13, "substrate" should read --heater board--;
Line 28, "substrate" should read --heater board--;
Line 52, "portion" should read --portions-- and "substrate" should read --heater board--.

COLUMN 4

Line 31, "it member" should read --its member--.

COLUMN 5

Line 6, "are a" should read --are--.

UNITED STATES PATENT AND TRADEMARK OFFICE

CERTIFICATE OF CORRECTION

PATENT NO. : 5,992,981

DATED : November 30, 1999

INVENTOR(S) : HIROSHI SUGITANI ET AL.

It is certified that error appears in the above-identified patent and that said Letters Patent is hereby corrected as shown below:

COLUMN 6

Line 24, "polypropyrene. The" should read --polypropylene. ¶The--;
Line 48, "1101" should read --1101,--.

COLUMN 11

Line 32, "90" should read --90°-- [not bold].

COLUMN 16

Line 24, "is contact." should read --is in contact.--.

COLUMN 17

Line 41, "convex pattern" should read --lip--.

COLUMN 18

Line 14, "lip method" should read --lip forming method--;
Line17, "pattern" should read --lip--.

COLUMN 20

Line 67, "comprise" should read --comprises--.

UNITED STATES PATENT AND TRADEMARK OFFICE

CERTIFICATE OF CORRECTION

PATENT NO. : 5,992,981

DATED : November 30, 1999

INVENTOR(S) : HIROSHI SUGITANI ET AL.

It is certified that error appears in the above-identified patent and that said Letters Patent is hereby corrected as shown below:

COLUMN 22

Line 5, "now passages" should read --flow passages--;
Line 33, "heater" should read --said heater--;

Signed and Sealed this

First Day of May, 2001

Nicholas P. Godici

*Attest:*

NICHOLAS P. GODICI

*Attesting Officer*

*Acting Director of the United States Patent and Trademark Office*